US005794096A

United States Patent [19]

Okabayashi

[11] Patent Number: 5,794,096

[45] **Date of Patent: *Aug. 11, 1998**

[54] INDUCTION TYPE HEAT FIXING DEVICE

[75] Inventor: Eiji Okabayashi, Toyokawa, Japan

[73] Assignee: Minolta Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 736,458

[22] Filed: Oct. 24, 1996

[30] Foreign Application Priority Data

| | | | |
|---|---|---|---|
| Oct. 25, 1995 | [JP] | Japan | 7-278062 |
| Oct. 26, 1995 | [JP] | Japan | 7-278687 |
| Nov. 9, 1995 | [JP] | Japan | 7-291376 |
| Dec. 1, 1995 | [JP] | Japan | 7-314360 |
| Dec. 5, 1995 | [JP] | Japan | 7-316466 |

[51] Int. Cl.[6] ..... G03G 15/20

[52] U.S. Cl. ..... 399/33; 219/216; 219/497; 219/663; 399/69

[58] Field of Search ..... 399/33, 67, 69, 399/70, 330; 219/216, 619, 663, 665, 666, 497

[56] References Cited

U.S. PATENT DOCUMENTS

| | | | |
|---|---|---|---|
| 3,816,690 | 6/1974 | Mittelmann | 219/663 |
| 4,570,044 | 2/1986 | Kobayashi et al. | 219/619 |
| 4,617,442 | 10/1986 | Okuda | 219/663 |
| 4,810,847 | 3/1989 | Ito | 219/665 X |
| 4,994,852 | 2/1991 | Matsuuchi et al. | 399/33 |
| 5,526,103 | 6/1996 | Kato et al. | 219/216 X |
| 5,555,074 | 9/1996 | Haragakiuchi et al. | 399/69 |

FOREIGN PATENT DOCUMENTS

| | | |
|---|---|---|
| 0 649 072 A1 | 4/1995 | European Pat. Off. . |
| 59-33474 | 2/1984 | Japan . |
| 59-33475 | 2/1984 | Japan . |
| 59-33476 | 2/1984 | Japan . |
| 59-33477 | 2/1984 | Japan . |

*Primary Examiner*—Arthur T. Grimley
*Assistant Examiner*—Sophia S. Chen
*Attorney, Agent, or Firm*—McDermott, Will & Emery

[57] ABSTRACT

The present invention relates to an induction type heat fixing device. In the induction type fixing device, a high frequency current is supplied to a coil by switching an electric current supply to coil between a supply state and an interrupted state so that an induction current is generated in a fixing roller (heat-receiving member). The high frequency current is controlled in accordance with at least one of the voltage fluctuation of the electric power source, the amount of coil current and the coil voltage.

18 Claims, 31 Drawing Sheets

INDUCTION TYPE HEAT FIXING DEVICE

BACKGROUND OF THE INVENTION

1. Field of the invention

The present invention relates to an induction type heat fixing device, and more specifically relates to an induction heat fixing device for fusing a toner image on a sheet by heating a heat-receiving member via induction heating.

2. Description of the Related Art

Image forming apparatuses such as electrophotographic type copiers and printers and the like are provided with a fixing device for fusing a toner image transferred onto a sheet such as a recording sheet or transfer sheet acting as a transfer member.

The fixing device is provided with, for example, a fixing roller to thermally fuse toner on a sheet, and a pressure roller which comes into contact with the fixing roller so as to grip said sheet therebetween. The fixing roller is cylindrical in configuration, and a heating source is supported on the center axis of said fixing roller via a support means. The heating source may comprise, for example, a halogen lamp or the like, which generates heat by the application of a predetermined voltage. The heating source is positioned on the center axis of the fixing roller such that the heat produced by the heating source uniformly irradiates the width of the interior wall of the fixing roller, and heats the exterior wall of the fixing roller to a temperature suitable for toner fusion (e.g., 150° to 200° C.). In this state, the fixing roller and pressure roller are rotated in mutually opposite directions while in contact one with another so as to grip the sheet with adhered toner therebetween. At the region of contact (hereinafter referred to as "nip") between the fixing roller and pressure roller, the toner on the sheet is melted by the heat of the fixing roller and is fixed to the sheet via the pressure achieved by the action of both rollers. After the toner is fixed, the sheet is transported via a discharge roller in conjunction with the rotation of said fixing roller and pressure roller and is ejected onto a discharge tray.

In the aforesaid fixing device provided with a heating source comprising a halogen lamp or the like, a long time is required after a power source is turned ON until the temperature of the fixing roller attains a predetermined temperature suitable for fixing. A disadvantage is that a user cannot use the copying machine or the like during this warm up time.

A fixing device of the induction heating type has been proposed to reduce the aforesaid warm up time (refer to Japanese Unexamined Patent Application No. SHO 59-337788). This induction heating type fixing device has a spirally wound coil arranged within a fixing roller comprised of a metal conductive member. An induction current is generated in the fixing roller by a high frequency current flowing through said coil, so as to produce Joule heat in the fixing roller via the intrinsic resistance of the fixing roller itself.

This induction type heat fixing method provides the advantages described below in comparison to other heating methods.

Firstly, there is faster temperature rise and scant heat generation and heat transfer of areas other than by the intermittent heating of near infrared heating such as a halogen lamp. Furthermore, there is no energy loss comparable to the light leakage of the halogen lamp. Secondly, heating efficiency is greater due to the heating effect of electromagnetic induction characteristics compared to surface heating of a fixing roller surface possessing a fixed resistance heat-generating member. Furthermore, reliability of this fixing device is greater over the long term because there is no oscillation contact.

Although the previously mentioned induction type heat fixing device has the aforesaid advantages, said device also possesses the following disadvantages.

Firstly, there is the disadvantage of a large output fluctuation relative to the power source voltage fluctuation compared to fixing devices using a halogen lamp.

Secondly, due to the sudden power consumption when the current begins to flow to the coil, there is a temporary reduction in the amount of current flowing to other components, e.g., other electrical components and illumination of displays of various functions, thereby producing a flickering of illumination.

Thirdly, in induction type heat fixing devices, safety measures are difficult when the heat-receiving member is at abnormally high temperature (over heated) due to the advantageous rapid temperature elevation speed, as previously described. Although it is thought that over heating of the heat-receiving member is prevented by stopping said heating when a uniform temperature is attained by the fixing roller which is disposed in the vicinity of a thermistor or temperature fuse in contact with said heat-receiving member, there is a certain time lag in the operation of said thermistor or temperature fuse. thus adequate effectiveness cannot be obtained due to the rapid speed of the temperature rise in induction heating.

Fourthly, an important aspect is the construction of the inventor circuit for supplying a high frequency current to the coil in induction type heat fixing devices. High frequency noise may be disadvantageously produced by the construction of said inventer circuit.

Fifthly, power loss may occur due to switching of the switching circuit of the inventer circuit generating the high frequency current supplied to an induction type heat fixing device.

SUMMARY OF THE INVENTION

An object of the present invention is to provide an improved induction type heat fixing device.

Another object of the present invention is to provide an induction type heat fixing device that are not unaffected by fluctuation of the power source voltage.

Another object of the present invention is to provide an induction type heat fixing device for executing a soft start to suppress flicker phenomenon produced by changes of the current consumed for heating output of the fixing device.

Still another object of the present invention is to provide an induction type heat fixing device which respond quickly to abnormally high temperature in place of a thermistor or temperature fuse.

A still further object of the present invention is to provide an induction type heat fixing device capable of maintaining uniform heating output without the disadvantage of ineffective current generation or high frequency noise generation.

An even further object of the present invention is to provide an induction type heat fixing device capable of suppressing switching loss to a minimum limit.

These and other objects are achieved by providing a fixing device which used in an image forming apparatus for fixing a toner image on a sheet, said fixing device comprising: a driving circuit which produces a high frequency current from an electric power of a power source and supplies the high frequency current to said coil so as to generate an induction current in said heat-receiving member and heat said heat-receiving member; wherein said driving circuit includes; a detection means for detecting an amount of voltage fluctuation of said power source, and a compensation means which controls the high frequency current supplied to said coil in accordance with the voltage fluctuation amount detected by said detection means for compensating the voltage fluctuation.

Furthermore, these and other objects are achieved by providing a fixing device which used in an image forming apparatus for fixing a toner image on a sheet, said fixing device comprising: a heat-receiving member comprised of a metal conductive member for generating heat and thermally fusing the toner image on the sheet; a coil which is arranged near said heat-receiving member; and a driving circuit which produces a high frequency current and supplies the high frequency current to said coil so as to generate an induction current in said heat-receiving member and heat said heat-receiving member, said driving circuit gradually increasing an electric power of the high frequency current supplied to said coil at start of heating.

Furthermore, these and other objects are achieved by providing a fixing device which used in an image forming apparatus for fixing a toner image on a sheet, said fixing device comprising: a heat-receiving member comprised of a metal conductive member for generating heat and thermally fusing the toner image on the sheet; a coil which is arranged near said heat-receiving member; and a driving circuit which produces a high frequency current and supplies the high frequency current to said coil so as to generate an induction current in said heat-receiving member and heat said heat-receiving member; wherein said driving circuit includes a detection circuit which detects the maximum value of the voltage supplied to said coil and prevents said driving circuit from supplying the high frequency current to the coil for preventing overheating of the heat-receiving member when the detected maximum value exceeds a predetermined value.

Furthermore, these and other objects are achieved by providing a fixing device which used in an image forming apparatus for fixing a toner image on a sheet, said fixing device comprising: a heat-receiving member comprised of a metal conductive member for generating heat and thermally fusing the toner image on the sheet; a coil which is arranged near said heat-receiving member; and a driving circuit which produces a high frequency current and supplies the high frequency current to said coil so as to generate an induction current in said heat-receiving member and heat said heat-receiving member; wherein said driving circuit includes; a switching circuit which switches a current supply to said coil between a supply state and an interrupted state to generate the high frequency current to said coil, a voltage detection circuit which detects the voltage supplied to said coil and causes the switching circuit to switch from the interrupted state to the supply state when the detected voltage falls bellow a voltage reference level, a current detection circuit which detects the amount of the current flowing to said coil and causes the switching circuit to switch from the supply state to the interrupted state when the detected current exceeds a current reference level, and a level setting circuit which determines said current reference level in accordance with the amount of the current flowing to said coil.

Still furthermore, these and other objects are achieved by providing a fixing device which used in an image forming apparatus for fixing a toner image on a sheet, said fixing device comprising: a heat-receiving member comprised of a metal conductive member for generating heat and thermally fusing the toner image on the sheet; a coil which is arranged near said heat-receiving member; and a driving circuit which produces a high frequency current from an electric power of a power source and supplies the high frequency current to said coil so as to generate an induction current in said heat-receiving member and heat said heat-receiving member; wherein said driving circuit includes; a switching circuit which switches a current supply to said coil between a supply state and an interrupted state to generate the high frequency current to said coil, a voltage detection circuit which detects the voltage supplied to said coil, and a delay circuit which causes said switching circuit to switch from the interrupted state to the supply state after a delay time has elapsed when the detected voltage falls bellow a reference level.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

The induction type heat fixing device of the present invention is described hereinafter with reference to the accompanying drawings.

The induction type heat fixing device comprises a main unit of said device and a drive circuit for driving the main unit of said device.

1. Induction Type Heat Fixing Device Main Unit

Figure 1:
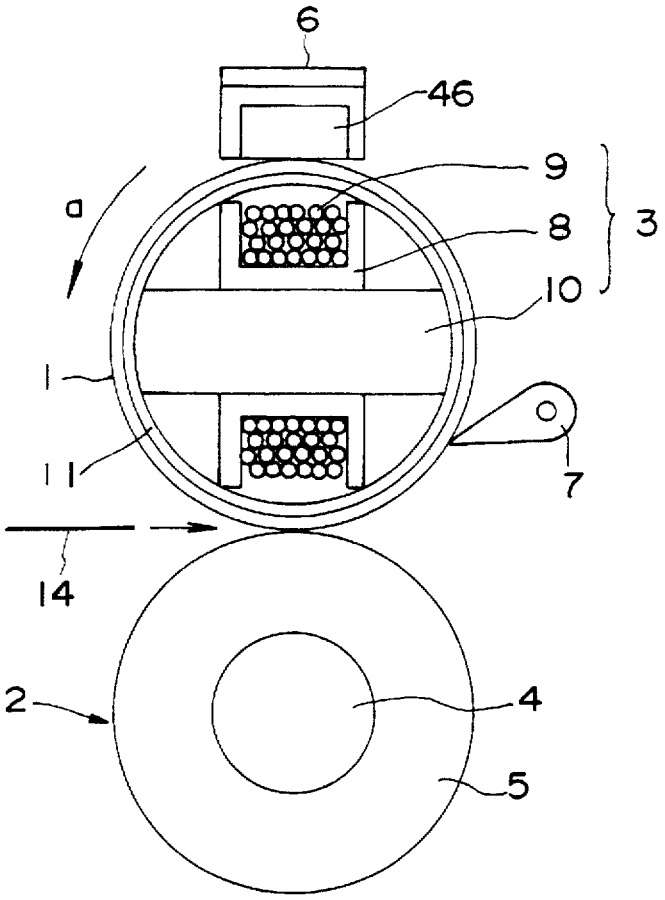
FIG. 1 is a section view briefly showing the construction of the induction type heat fixing device.

FIG. 1 is a section view briefly showing the construction of the main unit of the induction type heat fixing device.

As shown in FIG. 1, the induction type heat fixing device incorporated in a printer or the like is provided with a fixing roller 1 disposed so as to be rotatable in the arrow [a] direction, and a pressure roller 2 disposed in contact with said fixing roller 1 so as to be driven in rotation by the rotation of said fixing roller 1. Fixing roller 1 is an electrically conductive member in the form of a hollow cylindrical pipe, e.g., formed of an electrically conductive material such as carbon steel tube, stainless steel alloy tube, or aluminum alloy tube, the exterior surface of which is coated with a fluororesin to provide a heat resistance separation layer on the exterior surface. Thus, it is desirable that fixing roller 1 is formed of an electrically conductive magnetic member. On the other hand, pressure roller 2 comprises a core member 4 the surface of which is provided with silicon rubber layer 5, comprising a surface separation type heat resistance rubber layer.

Within fixing roller 1 is provided with a plurality of coil assemblies 3 arranged in the lengthwise direction of fixing roller 1, and which heat fixing roller 1 when an induction current is supplied to said fixing roller. Coil assemblies 3 are accommodated in holder 11 so as to provide a gap between said coils and the interior surface of fixing roller 1.

Fixing roller 1 is provided with a slide bearing on bilateral ends thereof, and is mounted to the fixing unit frame so as to be freely rotatable. Fixing roller 1 is provided with a fixed drive gear (not illustrated) on one end thereof, so as to be rotatably driven by a drive power source such as a motor or the like connected to said drive gear. In contrast, holder 11 is fixedly attached to the fixing unit frame, and does not rotate regardless of the rotation of fixing roller 1.

Figure 2:
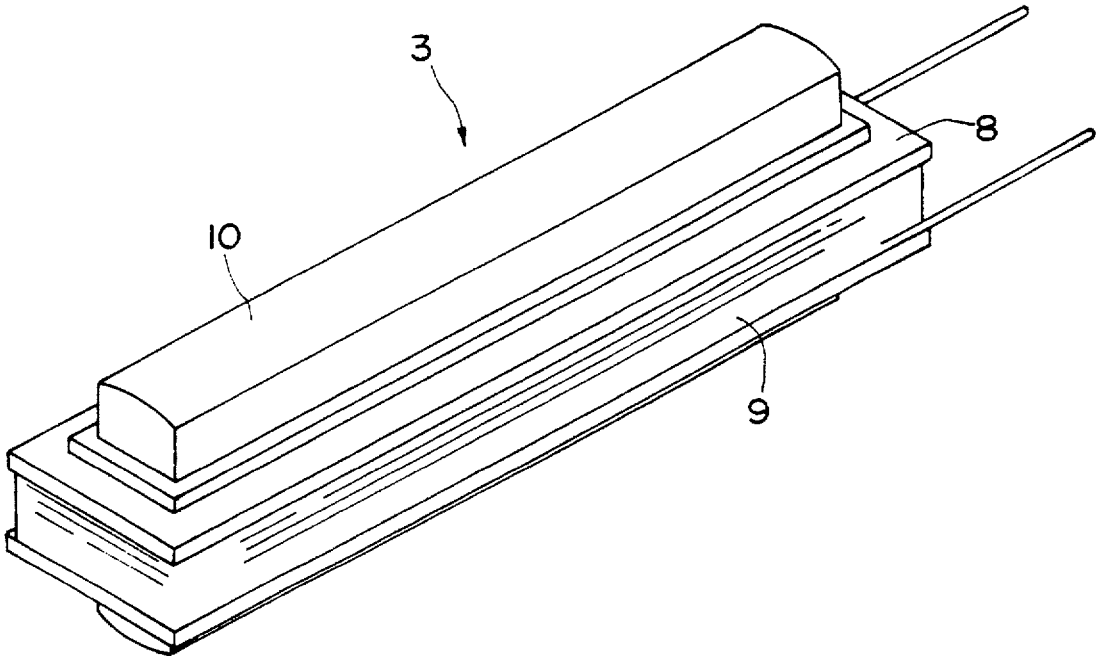
FIG. 2 is a perspective view of the coil assembly used in the induction type heat fixing device shown in FIG. 1.

As shown in FIG. 2 coil assembly 3 has a bobbin 8 and core 10; core 10 is inserted in a through hole having a rectangular aperture which is provided on bobbin 8, and copper wire 9 is wrapped around the surface of said bobbin 8. Copper wire 9 may be a copper litz wire or individual wire 0.8 mm in diameter and having a fusion layer and an insulation layer, and is wrapped around bobbin 8 in the direction of the rotational axis of fixing roller 1.

Core 10 comprises, for example, a ferrite core or laminate core. Bobbin 8 is formed by, for example, a ceramic or heat-resistant insulating engineering plastic, and has the function of regulating the shape of the wrapped copper wire by pressing against said wire.

Figure 3:
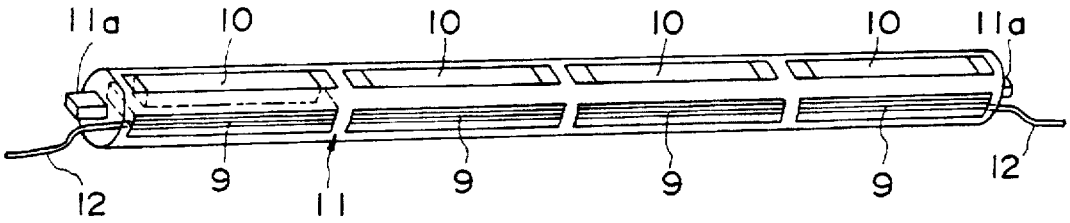
FIG. 3 is a perspective view of the holder supporting the coil assembly of FIG. 2.

As shown in FIG. 3, the holder 11 which accommodates the coil assembly 3 has a hollow cylindrical configuration, the exterior surface of which is provided with a plurality of holes passing through vertically in one direction and opposite direction, and laterally in one direction and an opposite direction. Protrusions 11*a* are provided at bilateral ends to attach the holder 11 to the device body. Holder 11 is formed of a heat-resistant insulative material such as polyphenylene sulfide (PPS), liquid crystal polymer and the like. The coil assembly 3 is assembled by inserting bobbin 8 in lateral holes provided in holder 11, and thereafter inserting core 10 in top and bottom holes to incorporate with holder 11. The plurality of coil assemblies 3 are electrically connected in serial within holder 11, and a lead 12 extends from bilateral ends of holder 11 for the high frequency current flow to said coils.

Above fixing roller 1 are provided a thermistor 6 for detecting the temperature of the fixing roller, and, as a safety mechanism during times of abnormal temperature elevation, a thermostat 46 for interrupting the current supplied to the coils when an abnormally high temperature is detected.

Induction type heat fixing devices of the aforesaid construction receives power from a drive circuit described later to accomplish heating. A high frequency current is supplied from a driver circuit to the coils via lead wires 12. Thus, an induction current is generated in fixing roller 1, and said fixing roller 1 is heated.. The temperature of fixing roller 1 is detected by thermistor 6. The power from the drive circuit is controlled in accordance with the aforesaid detected temperature, so as to maintain the temperature of fixing roller 1 at a uniform temperature necessary for fixing a toner image.

The main unit of the induction type heat fixing device of the previously described construction operates as specified below.

First, a sheet 14 bearing an unfixed toner image is transported from the left of the drawing toward the nip area between the fixing roller 1 and the pressure roller 2. Sheet 14 is transported through the nip area while being subjected to the heat of fixing roller 1 and the pressure exerted by both rollers 1 and 2. Thus, the unfixed toner is fused and a fixed toner image is formed on sheet 14. After sheet 14 has passed the nip area, said sheet 14 is separated naturally from fixing roller 1, or is separated forcibly from fixing roller by a separation guide or separation hook 7 disposed such that the leading edge of said member rubs the surface of fixing roller 1, as shown in FIG. 1, and transported in a rightward direction in the drawing. Sheet 1 is ejected onto a discharge tray by a discharge roller not shown in the illustration.

Figure 4A:
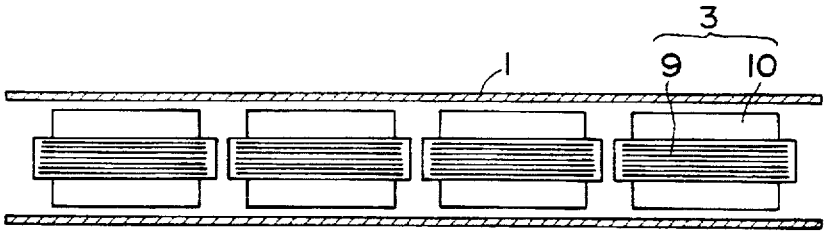
FIG. 4 illustrates another example of a coil assembly.
Figure 4B:
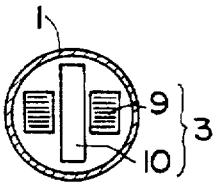

Although coil assembly 3 is provided with a bobbin 8, the present invention is not limited to such an arrangement inasmuch as a coil assembly 3 may be formed by winding copper wire 9 directly on core 10, as shown in FIG. 4.

Figure 5A:
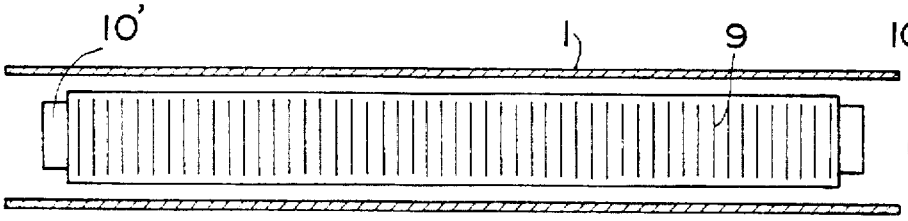
FIG. 5 illustrates another example of a coil assembly.
Figure 5B:
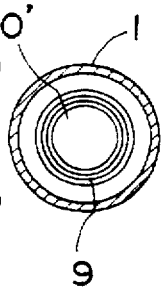

Furthermore, copper wire 9 may be wound spirally on cylindrical core 10' having the same length as fixing roller 1, as shown in FIG. 5.

In addition to direct heating of a fixing roller 1 used as a heat-receiving member as described above, a metal heating plate 1' may be used as a heat-receiving member wherein provided adjacent thereto are a core 10' and a copper wire 9 wound around the core 10'. In this instance, a metal heating plate 1' such as is shown in the drawing may be provided within the fixing roller, and in place of said fixing roller, said metal plate 1' may press against pressure roller 2 through a flexible film driven by the movement of the sheet between the pressure roller and the metal heating plate 1'.

Figure 7:
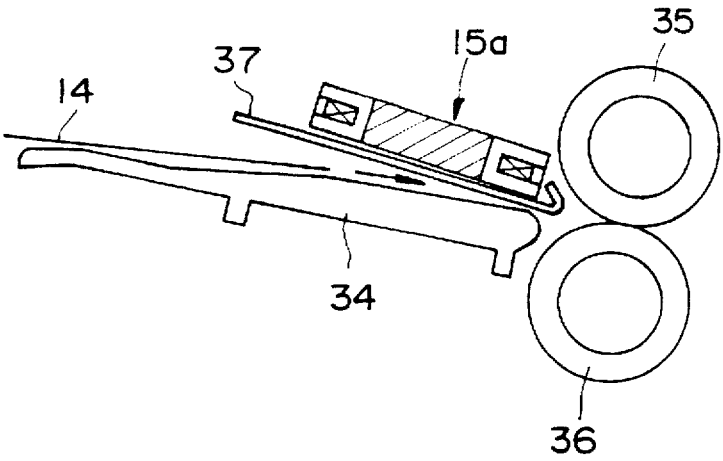
FIG. 7 briefly shows another the construction of an induction type heat fixing device.

FIG. 7 is a section view briefly showing the construction of the main unit of an induction type heat fixing device of a different type.

Figure 8:
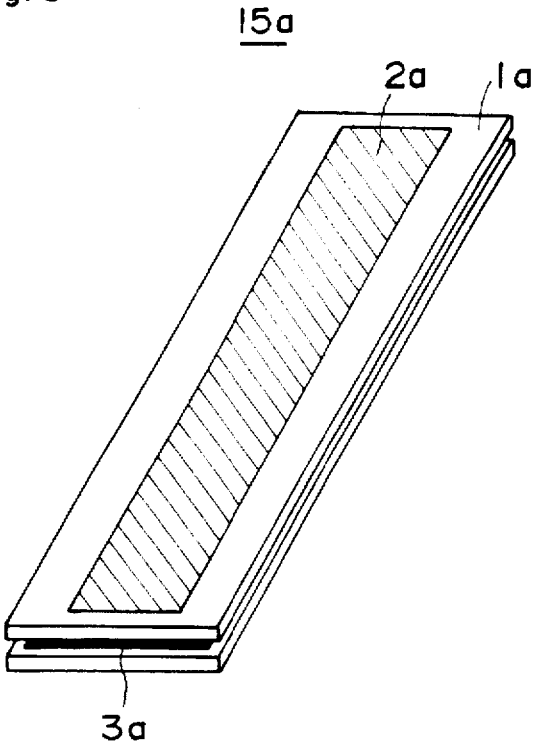
FIG. 8 is a perspective view of a coil assembly used in the induction type heat fixing device of FIG. 7.

In the induction type heat fixing device of FIG. 7, top fixing guide 37 formed as an electrically conductive guide member is provided as a heat-receiving member. The inductive type heat fixing device is provided with a coil assembly 15*a* for supplying an induction current to said top fixing guide 37, and roller pair 35 and 36 for gripping and transporting a sheet 14. Coil assembly 15*a* comprises a core 2*a* and coil 3*a* supported on a bobbin 1*a*, and is mounted at a position facing sheet 14 via top fixing guide 37, as shown in FIG. 8. Roller pair 35 and 36 are disposed downstream of top fixing guide 37 and bottom fixing guide 34 in the sheet transport direction. The top fixing guide 37 cooperates with the bottom fixing guide 34 so as to guide a sheet 14 to the roller pair 35 and 36. The surface of the rollers of roller pair 35 and 36 is coated with a member possessing release characteristics relative to toner, e.g., fluororesin, silicone rubber or the like.

In the aforesaid construction, an induction current is produced in top fixing guide 37 by means of a high frequency current flowing to coil 3*a* so as to heat said top fixing guide 37. The high frequency current flowing to coil 3*a* is supplied via a drive circuit described later.

The sheet 14 bearing the transferred toner image is transported from the left side in FIG. 8, and heated by the heated top fixing guide 37 while in a state of noncontact therewith. The toner in this area is softened somewhat as a certain degree of heat accumulates in the toner and sheet 14. Then, sheet 14 is transported to the nip area formed by roller pair 35 and 36. The toner is fused to sheet 14 by means of the pressure of the nip area and the heat accumulated by the toner and sheet 14.

The temperature of fixing guide 37 is detected by a thermistor, such that the temperature of said fixing guide 37 can be maintained at a temperature necessary to accomplish fixing based on said detected temperature.

2. Drive Circuit

Various drive circuits for supplying a high frequency current to the main unit of induction type heat fixing devices as previously mentioned and driving said induction type heat fixing devices are described hereinafter as the first through tenth embodiments with reference to the accompanying drawings. Although fixing roller 1, metal heating plate 1', and fixing guide 37 have been described as heat-receiving members heated by induction heating in the preceding discussion of an induction type heat fixing device, these components are referred to collectively as heat-receiving member 30 in the following description of the drive circuit. Similarly, although various coils for generating an induction current to the heat-receiving member have been described in the description of the induction type heat fixing device, these coils are referred to collectively as induction heating coil 90 in the following description of the drive circuit. In the description of the drive circuit below, circuits and components common to the various embodiments are referred to by common reference numbers.

2-1. First Embodiment

Figure 9:
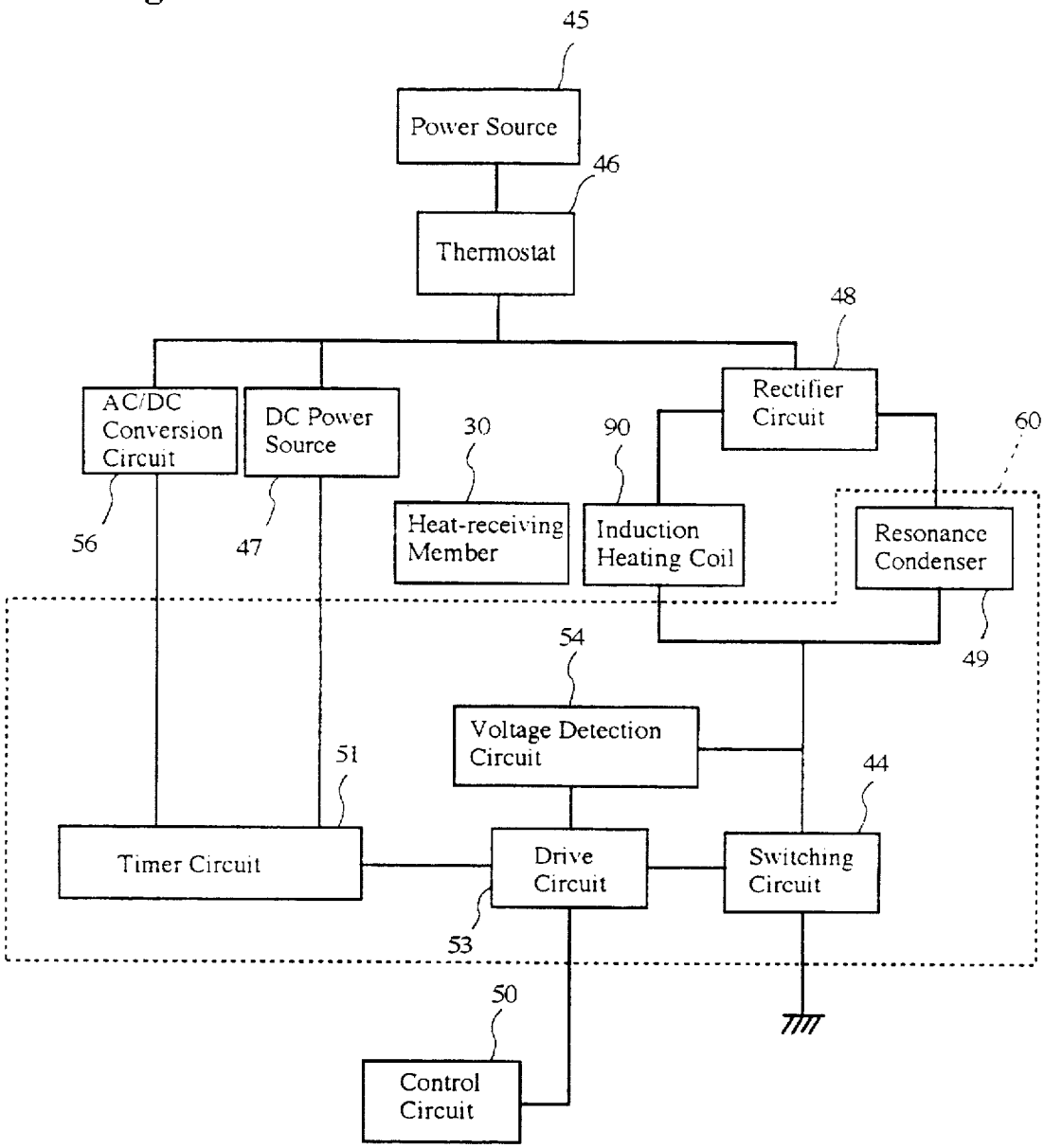
FIG. 9 is a block diagram of a first embodiment of a drive circuit for executing drive control of a induction type heat fixing device.

FIG. 9 is a block diagram showing the construction of the drive circuit of a first embodiment.

An alternating current from a commercial power source (100 V AC) 45 is rectified by rectification circuit 48, and converted to a high frequency by inverter circuit 60, then supplied to induction heating coil 90. The current flowing to inverter circuit 60 is supplied via thermostat 46, such that the power source current may be interrupted by thermostat 46 when heat-receiving member 30 attains an abnormal temperature.

Resonance condenser 49 is connected in parallel with induction heating coil 90, to comprise an LC resonance circuit. Furthermore, a switching circuit 44 is connected in series with the LC resonance circuit and rectifier circuit 48. This switching circuit 44 comprises, for example, a transistor, field-effect transistor (FET), or IGBT, and said switching circuit 44 switches the current supply to the LC resonance circuit (induction heating coil 90 and resonance condenser 49) between a supply state and an interrupted state via the switching of said switching circuit 44 via drive circuit 53. The OFF time of the switch circuit 44 is determined by the voltage detection circuit 54, and the ON time of switch circuit 44 is determined by timer circuit 51. Repeated ON/OFF switching of this switching circuit 44 allows a high frequency current (AC current) to flow to the coil so as to produce induction heating of the heat-receiving member 30. That is, the frequency of the high frequency current supplied to the induction heating coil 90 is determined by the aforesaid switching operation.

Voltage detection circuit 54 determines the OFF time by detecting the voltage generated by the resonance of the resonance condenser 49 and induction heating coil when said voltage drops below a constant voltage value, and outputting an ON signal to the drive circuit 53. Drive circuit 53 turns ON switching circuit 44 in accordance with the aforesaid output ON signal.

On the other hand, timer circuit 51 counts a predetermined time after switching circuit 44 is turned ON, and when said counting ends, outputs an OFF signal to drive circuit 53. Drive circuit 53 turns ON switching circuit 44 in accordance with said ON signal. The timer circuit 51 simply comprises a resistor and condenser, and utilizes the discharge characteristics of said resistor and condenser to determine the ON time of switching circuit 44 by inputting a first reference voltage of a fixed voltage output from DC power source 47 and a second reference voltage of variably voltage proportional to an output voltage of the power source 45 by AC/DC conversion circuit 56, and determining the potential difference of said voltages (first reference voltage minus the second reference voltage).

Accordingly, when the power source voltages rises there is minimal difference of potential because the second reference voltage is higher, and the output time is reduced for the signals output from timer circuit 51 to effectually reduce the ON time of switching circuit 44, thereby accomplishing correction to avoid excessive output. When the power source voltage is reduced, on the other hand, there is a large potential difference because the second reference voltage is reduced, and the output time is increased for the signals output from timer circuit 51 to effectually lengthen the ON time of switching circuit 44, thereby accomplishing correction to avoid under output. That is, timer circuit 51 functions as a correction circuit to correct the output of the high frequency power source (inverter circuit 60).

The correction function of the correction circuit is described in detail below.

Figure 10:
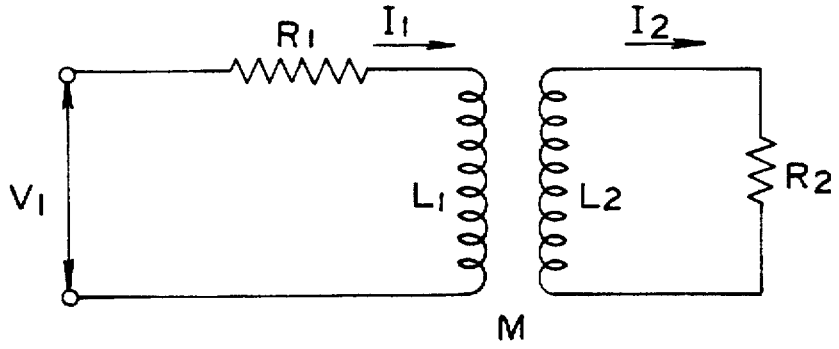
FIG. 10 is an equivalent circuit of a induction type heat fixing device.

FIG. 10 shows the induction type heat fixing device as an equivalent circuit. In the drawings and equations hereafter, $L_1$ represents the inductance of induction heating coil 90, $R_1$ represents the resistance value of induction heating coil 90, $L_2$ represents the inductance of heat-receiving member 30, $R_2$ represents the resistance value of heat-receiving member 30, $V_1$ represents the voltage value of the high frequency current (AC) supplied to induction heating coil 90, $I_1$ represents the current value flowing to induction heating coil 90, $I_2$ represents the current value (induction current) flowing to heat-receiving member 30, M represents mutual inductance, k represents a coupling constant, t represents a reciprocal of the frequency of the high frequency current, W represents the amount of heat generation of heat-receiving member 30, ω represents the angular speed, and j represents an imaginary number.

First, the current flowing to heat-receiving member 30 is an inductance current, from which the voltages on the induction heating coil 90 side and the heat-receiving member 30 side are expressed by Equations 1 and 2 below.

$$V_1=(R_1+j\omega L_1)I_1+j\omega MI_2 \quad (1)$$

$$0=j\omega MI_1+(R_2+j\omega L_2)I_2 \quad (2)$$

The relationship of mutual inductance M and coupling constant k is expressed by Equation 3 below.

$$k=\frac{M}{\sqrt{L_1L_2}} \quad (3)$$

The current $I_2$ flowing to heat-receiving member 30 of Equation 2 can be substituted for M of Equation 3 to derive Equation 4 below.

$$I_2=\frac{-j\omega k\sqrt{L_1L_2I_1}}{R_2+j\omega L_2}=\left(\frac{-\sqrt{L_1L_2I_1}}{R_2^2+\omega^2L_2^2}\right)(W^2kL_2+j\omega R_2k) \quad (4)$$

The values ω, k, $L_2$, and $R_2$ are constants determined by the material composition and configuration of the heat-receiving member 30, and since $\omega^2 >> R_2$, the following Equation 5 can be derived.

$$K=\frac{\omega^4k^2L_2^3R_2^2}{(R_2^2+\omega^2L_2^2)^2}=\frac{k^2L_2^3R_2^2}{\left(\frac{R_2^2}{\omega^2}+L_2^2\right)^2}=\frac{k^2R_2^2}{L_2} \quad (5)$$

The amount of heat generation W of heat-receiving member 30 is defined as W=(real number part of $I_2)^2$, from which K can be determined by substitution of Equation 4, such that W can be expressed by Equation 6 below.

$$W=I_2^2R_2=KL_1I_2^2 \quad (6)$$

The amount of heat generation of heat-receiving member 30 is proportional to the inductance of induction heating coil 90 and proportional to the square of the current of induction heating coil 90.

The relationship between the voltage and current flowing to induction heating coil 90 is expressed by Equation 7 below.

$$I_1=\frac{V_1}{L_1}t \quad (7)$$

When Equation 7 us substituted in Equation 6, Equation 8 is derived.

$$W=K\frac{V_1^2}{L_1}t^2 \quad (8)$$

From Equation 8, if the frequency of the high frequency current is a constant, the amount of heat generation of heat-receiving member 30, i.e., the heating output, is proportional to the square of voltage $V_1$ supplied to induction heating coil 90 and is variable.

The output fluctuation rate relative to the power source voltage fluctuation rate is shown in Equation 9 below, expressed by the power of Q. In the equation, V represents the pre-output fluctuation, V' represents the post fluctuation voltage, and W' represents the post fluctuation output.

$$\left(\frac{V'}{V}\right)^Q=\left(\frac{W'}{W}\right) \quad (9)$$

In the case of a halogen lamp, the value of Q is 1.54 in accordance with halogen lamp specification, whereas in the case of induction heating, a value of 2 is derived from Equation 8.

Since the voltage fluctuation of a commercial power source (100 V AC) is about 85 to 110%, and from Equation 9 the fluctuation of the warm up time and the output fluctuation of induction heating and of a halogen lamp are as shown in Table 1 below. Warm up time is inversely proportional to the input power.

TABLE 1

| | Fluctuation Rate |
|---|---|
| Power Source Voltage | 85 to 110% |
| Halogen Lamp | |
| Output | 78 to 116% |
| Warm Up Time | 128 to 86% |
| Induction Heating | |
| Output | 72 to 121% |
| Warm Up Time | 138 to 83% |

It can be understood from Table 1 that the induction heating is influenced more by power source voltage fluctuation than is a halogen lamp. When the power source voltage drops, therefore, the warm up time increases, and conversely, when the power source voltage rises, the temperature level increases.

In the present embodiment, the voltage $V_1$ supplied to induction heating coil 90 fluctuates due to the fluctuation of the power source voltage, and as previously described, the voltage $V_1$ supplied to induction heating coil 90 is corrected by changing switching time t, and the frequency of the high frequency current (AC) so as to not change the output W as expressed in Equation 8.

The first reference voltage is set so as to be supplied from the fixed voltage power source, i.e., the DC power source 47. The second reference voltage is set so as to be supplied from AC/DC conversion circuit 56 proportional to the power source voltage.

DC power source 47 is outputs the first reference voltage as a simple fixed voltage circuit, and is a regulated power source to provide a DC power source for drive circuit 53 and timer circuit 51. Control circuit 50 outputs control signals so that the temperature of fixing roller 1 attains a temperature necessary to accomplish fixing via the temperature detected by thermistor 6 disposed in contact with or adjacent to the heat-receiving member 30.

Figure 11:
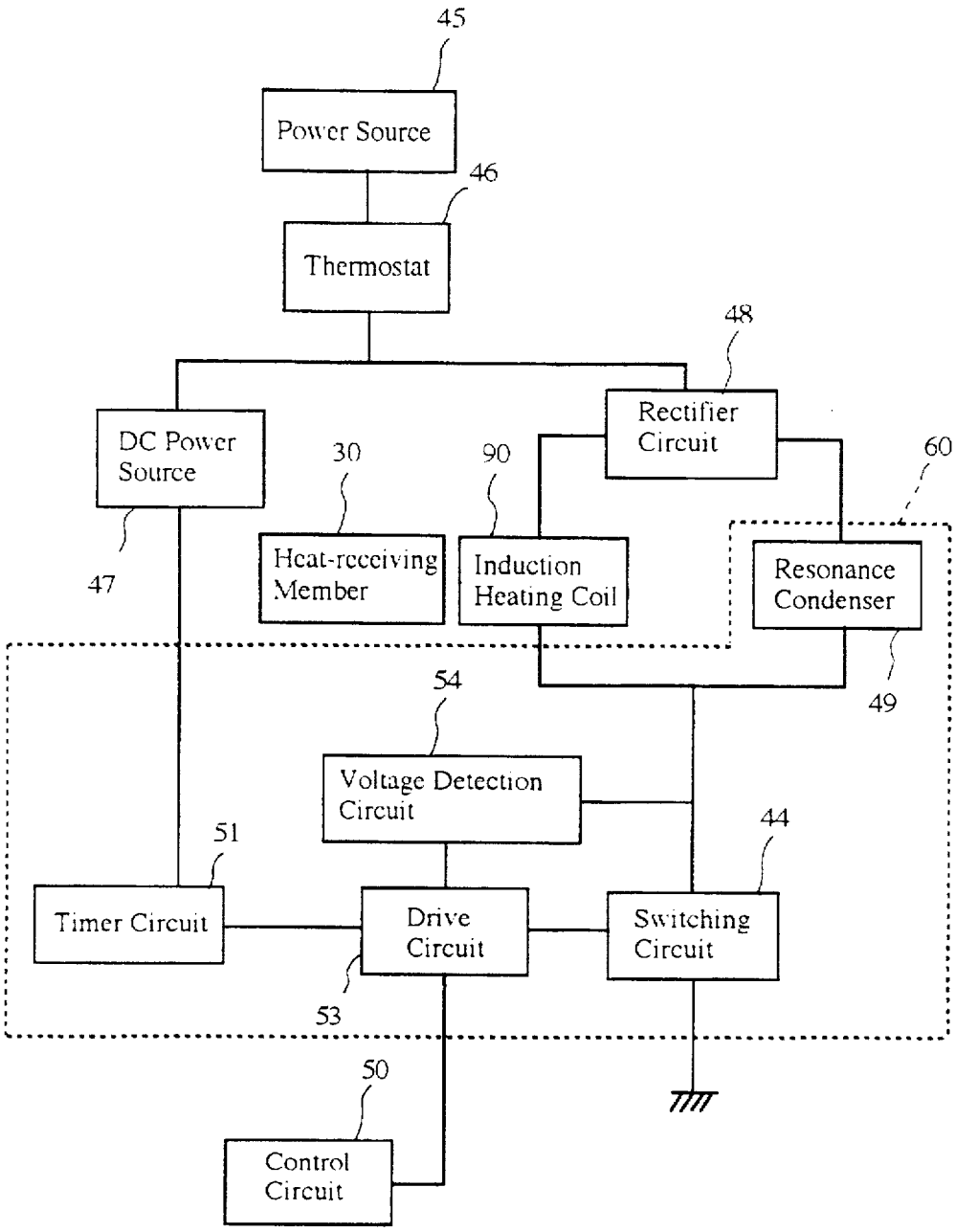
FIG. 11 is a block diagram of a drive circuit of an induction type heat fixing device of a comparative example.

A reference example which does not utilize the present invention is described hereinafter by way of comparison. FIG. 11 is a block diagram of a drive circuit not applicable to the present invention, wherein the construction does not provide the AC/DC conversion circuit 56 of the drive circuit of FIG. 9, that is, a reference voltage is only supplied from a fixed voltage power source of DC power source 47, and a second reference voltage set in accordance with the power source voltage fluctuation is not supplied to timer circuit 51. In other respects construction is identical to the drive circuit of FIG. 9.

Therefore, the heating output fluctuates due to the influence of power source voltage fluctuation because the ON time of switching circuit 44 is normally constant while the voltage of power source 45 (voltage supplied to induction heating coil 90) fluctuates and a constant reference voltage is only supplied to the condenser due to the resistance of the timer circuit 51.

Figure 12:
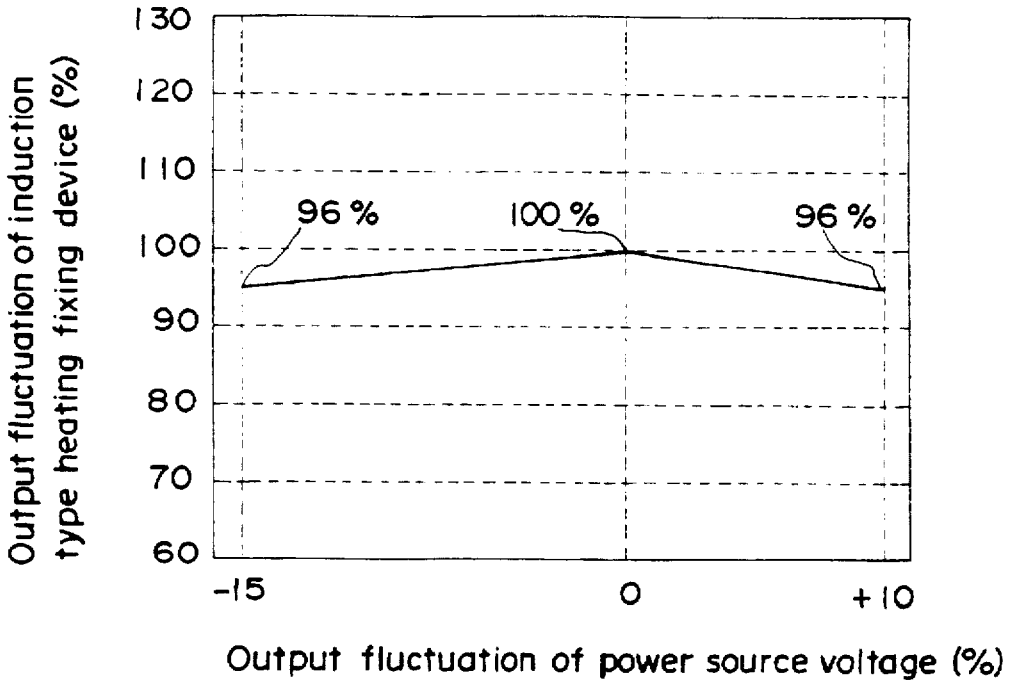
FIG. 12 is a graph showing the relationship between power source voltage fluctuation and output fluctuation when a induction type heat fixing device is driven by the drive circuit shown in FIG. 9.
Figure 13:
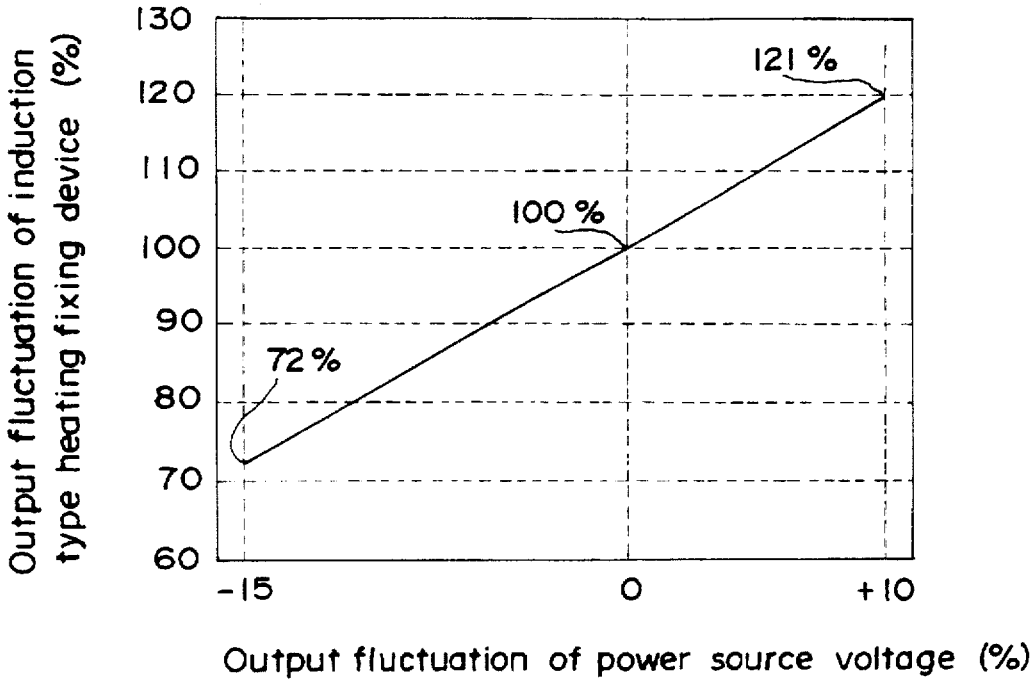
FIG. 13 is a graph showing the relationship between power source voltage fluctuation and output fluctuation when a induction type heat fixing device is driven by the drive circuit shown in FIG. 11.

FIG. 12 is a graph showing the relationship between output of the induction type heat fixing device and fluctuation of the power source voltage when the induction type heat fixing device is driven by the drive circuit of FIG. 9 of the present invention. FIG. 13 is a graph showing the relationship between output of the induction type heat fixing device and fluctuation of the power source voltage when the induction type heat fixing device is driven by the drive circuit of the reference example of FIG. 11.

In the drive circuit of FIG. 9, the output fluctuation is about 96 to 100% relative to fluctuation of the power source voltage, whereas in the drive circuit of FIG. 11, the output fluctuation is 72 to 121%. That is, in the drive circuit of FIG. 9, the output fluctuation relative to power source voltage fluctuation is about 1/10 that of the reference example (FIG. 11). In the reference example, the frequency of the high frequency current is unchanged by the power source voltage fluctuation and is normally 25 KHz, whereas in the case of the present invention, the frequency of the high frequency current is 20.5 KHz when the power source voltage os−15% (85%) due to power source voltage fluctuation, 25 KHz when the power source voltage is unchanged (±0%), and 28.9 KHz when the power source voltage is +10% (110%).

2-2. Second Embodiment

Figure 14:
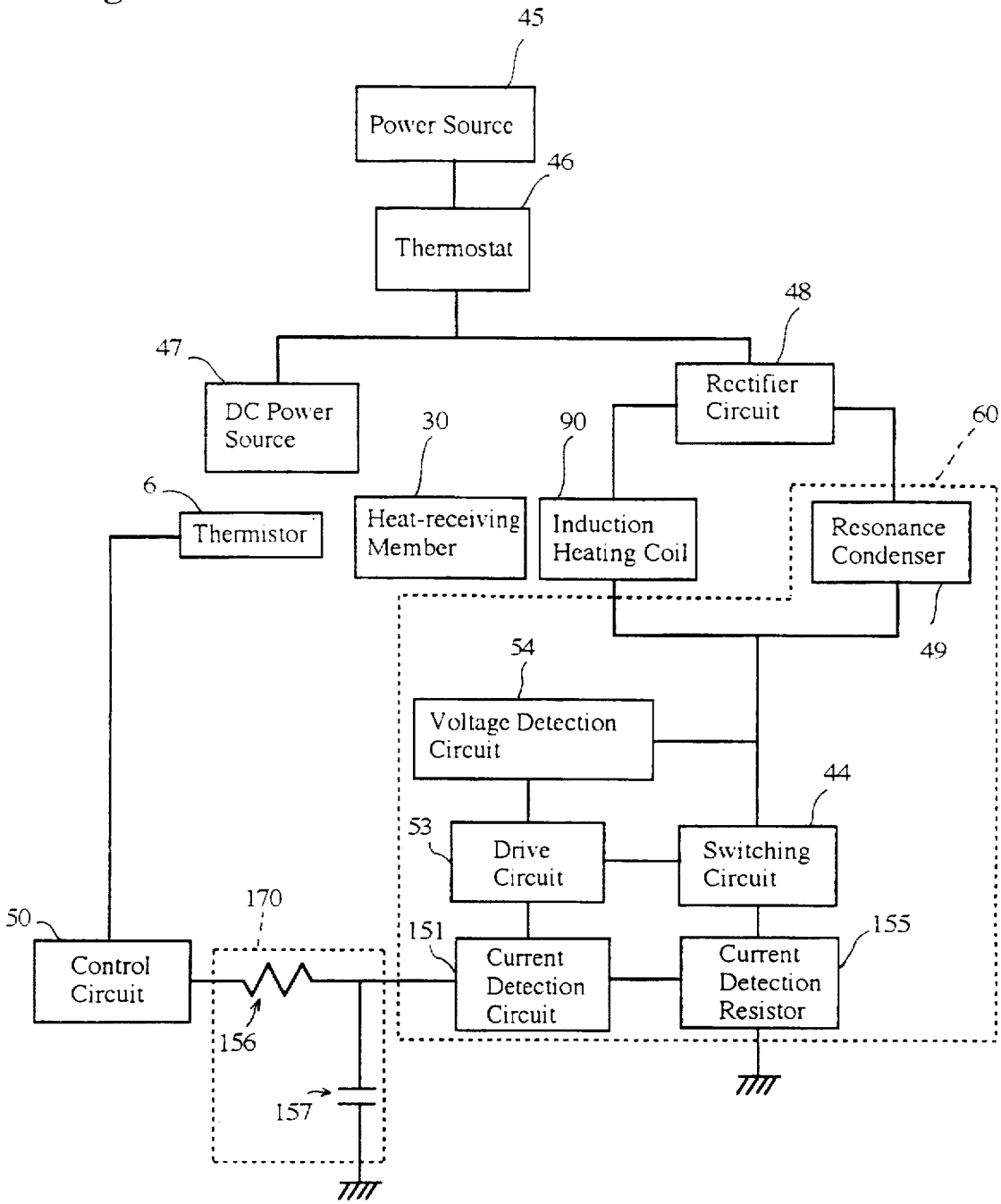
FIG. 14 is a block diagram of a second embodiment of a drive circuit for executing drive control of a induction type heat fixing device.

FIG. 14 is a block diagram of the drive circuit of the induction type heat fixing device of a second embodiment.

In the drive circuit of the second embodiment, just as in the drive circuit of the first embodiment, an alternating current (AC) from a commercial power source 45 is rectified to a direct current (DC) by rectifier circuit 48, and converted to a high frequency current by inverter circuit 60, then supplied to induction heating coil 90.

The frequency of the high frequency current supplied to the induction heating coil 90 is determined by the switching operation of switching circuit 44 in the same manner as in the first embodiment. The timing for turning ON the switching circuit 44 is determined by the voltage detection circuit 54, and timing for turning OFF the switching circuit 44 is determined by the current detection circuit 151. That is, the time interval during which switching circuit 44 is in an ON state is determined by current detection circuit 151, and the time interval during which switching circuit 151 is in an OFF state is determined by voltage detection circuit 54. Thus, a high frequency current (alternating current) flows to induction heating coil 90 via the repeated ON/OFF switching of said switching circuit 44 so as to accomplish induction heating of fixing roller 1.

Figures 15A, 15B, 15C:
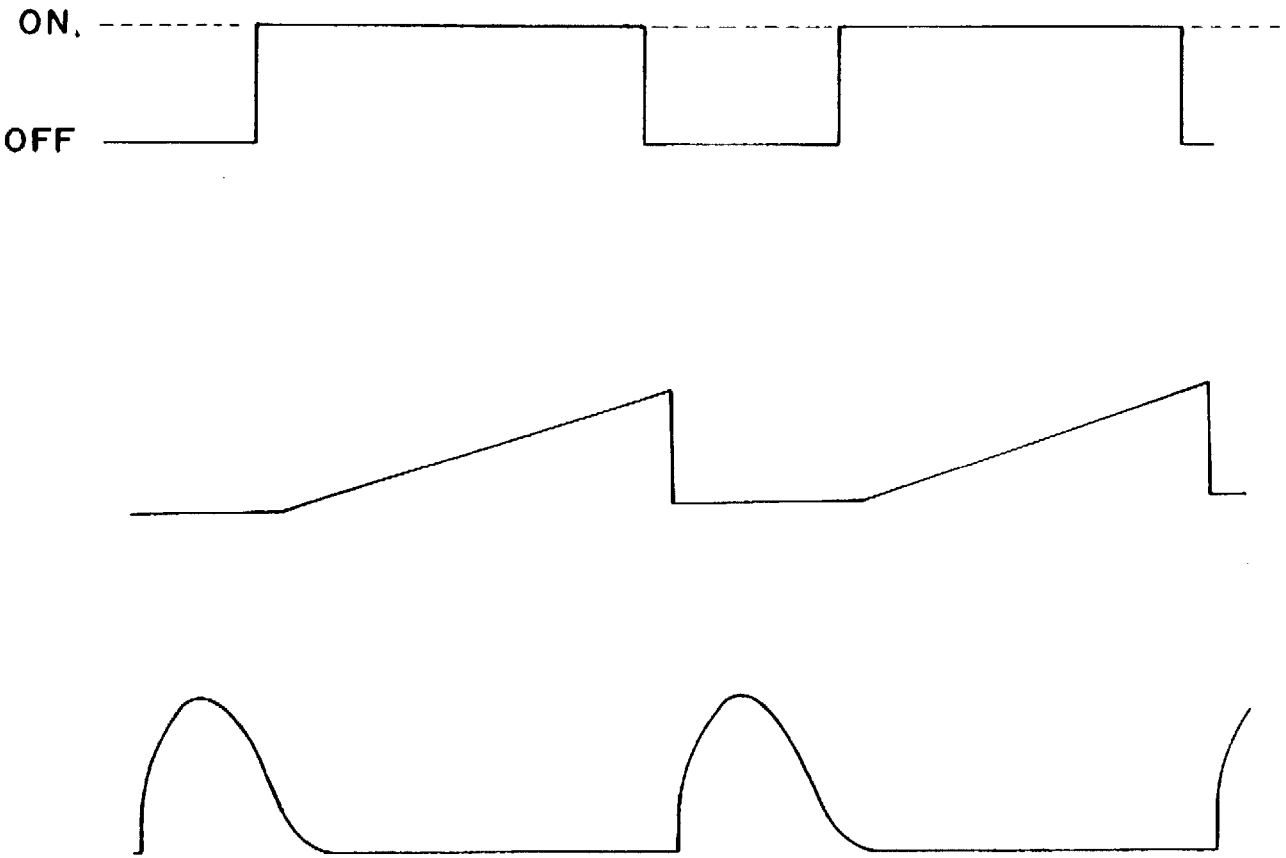
FIG. 15 is a timing chart showing the operation timing of induction heating accomplished via the drive circuit of FIG. 13.

This process is described hereinafter with reference to the timing chart of FIG. 15. First, a current flows to induction heating coil 90 by turning ON the switching circuit 44 as shown in (A) of the FIG. 15. On the other hand, current detection circuit 151 detects the voltage supplied to current detection resistor 155, and transmits a signal to drive circuit 53 so as to turn OFF switching circuit 44 when the detected voltage exceeds a reference voltage. The voltage supplied to current detection resistor 155 for detecting of current detection circuit 151 is shown in (B) of the drawing. When switching circuit 44 is turned OFF, a resonance current flows between induction heating coil 90 and resonance condenser 49, and when voltage detection circuit 54 detects a drop in the voltage to near 0 V on the induction heating coil 90 side of the switching circuit 44 due to said resonance, a signal is transmitted to drive circuit 53 to again turn ON switching circuit 44. The waveform of the voltage detected by voltage detection circuit 54 is shown in (C) of the drawing. Thereafter, a high frequency current flows to induction heating coil 90 by means of repeating the aforesaid switching operation.

The reference voltage is set by resistor 156 and condenser 157 which comprise a time constant circuit 170. When the temperature of the heat-receiving member 30 detected by thermistor 6 drops below a predetermined temperature, control circuit 50 supplies a control signal of a predetermined voltage to time constant circuit 170. Thus, the condenser 157 of time constant circuit 170 begins discharging, and the voltage value of the reference voltage supplied to current detection circuit 151 is gradually increased in accordance with the time constant of resistor 156 and condenser 157. Accordingly, the time interval of the ON state of switching circuit 44 gradually increases as shown in FIG. 15 by means of the gradual increase of the reference voltage, such that the heating output is gradually elevated. In other words, a so-called "soft start" is realized.

The reference voltage determined by resistor 156 and condenser 157 comprising the time constant circuit 170 has discharge characteristics expressed by Equation 10 below.

$$v_t = v_0 \left\{ 1 - \exp\left( -\frac{t}{CR} \right) \right\} \quad (10)$$

In the equation, $v_0$ is the reference voltage value (set reference voltage value) $v_r$ after discharge is completed, $v_t$ is the reference voltage value at time T, R is the resistance value of resistor 156, C is the capacity of condenser 157.

Figure 6A:
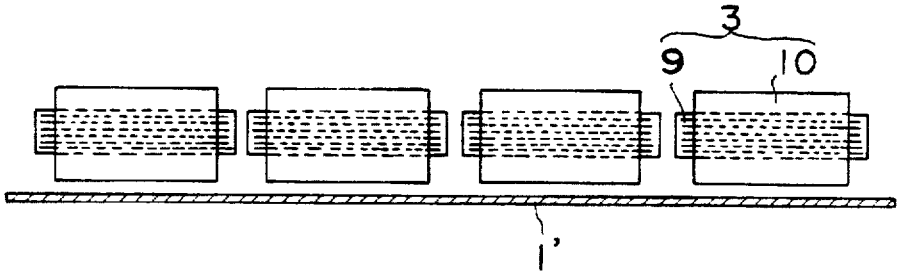
FIG. 6 illustrates another example of a coil assembly.
Figure 6B:
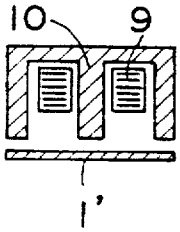

As previously described with reference to FIG. 6, the amount of heat generation of heat-receiving member 30 is proportional to the inductance of induction heating coil 90, and proportional to the square of the current of induction heating coil 90.

Therefore, since heat generation W is proportional to the square of the current of induction heating coil 90, the amount of heat generation W (heat output W) is proportional to the square of reference voltage $v_r$ determining the coil current.

$$W \propto v_1^2 \quad (11)$$

Figure 16:
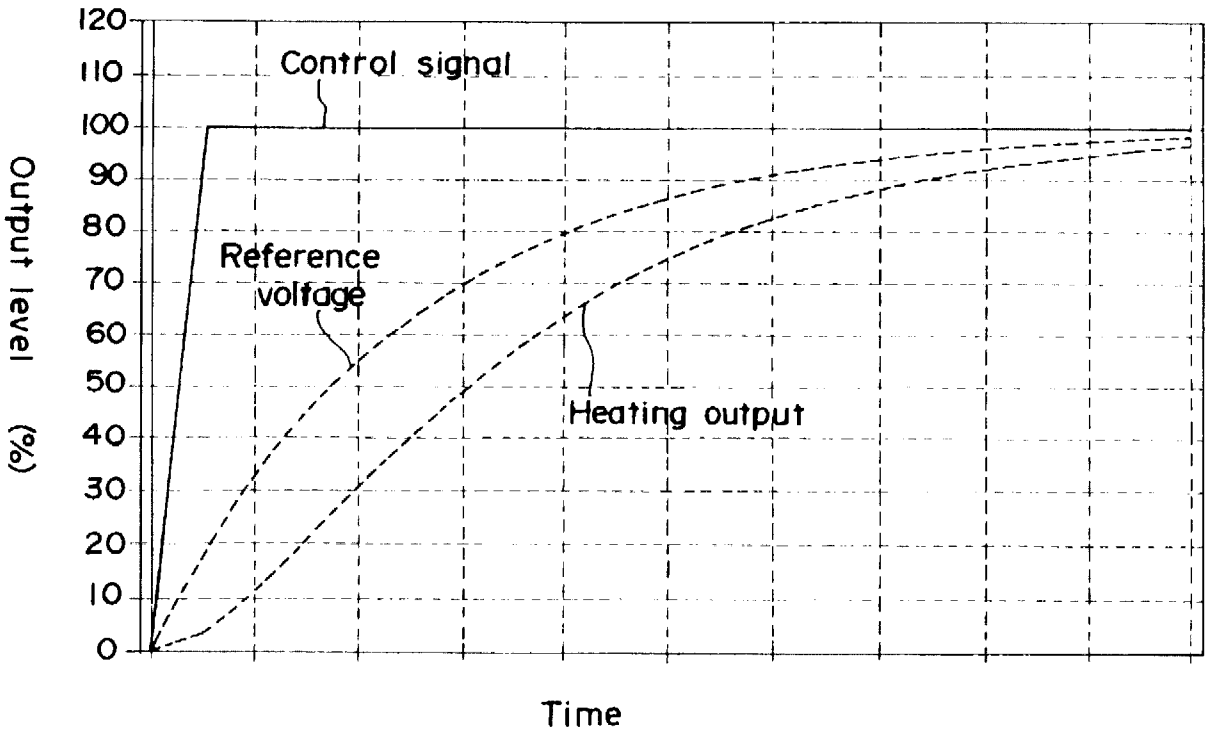
FIG. 16 is a graph showing the relationships among time, control signals, reference voltage, heat output at the start of heating in the drive circuit of FIG. 13.
Figure 17:
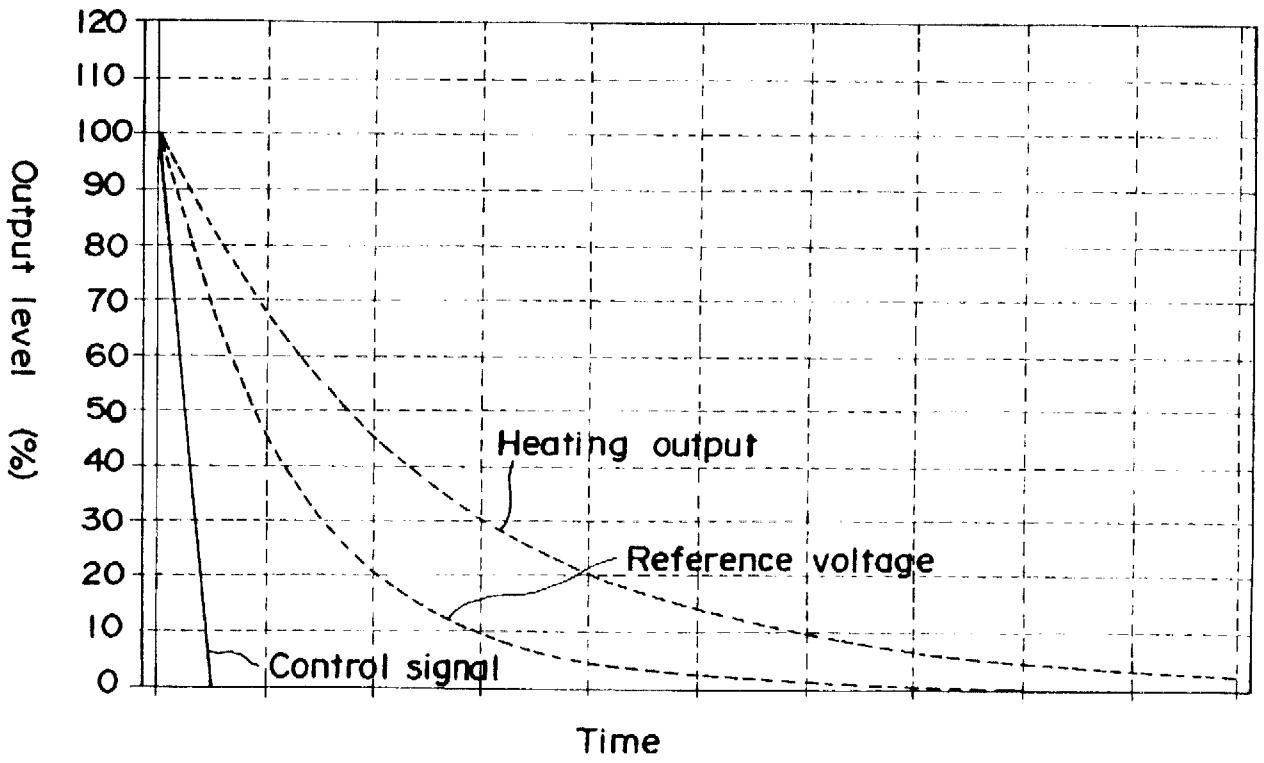
FIG. 17 is a graph showing the relationships among time, control signals, reference voltage, heat output at the end of heating in the drive circuit of FIG. 13.

The relationships among the previously described control signals, reference voltages, and heating output are shown in FIGS. 16 and 17. FIG. 16 is a graph of the heating start time, and FIG. 17 is a graph of the heating end time.

As shown in FIG. 16, at the heating start time, there is a gradual increase of the reference voltage relative to the control signal rise, and a gradual increase of the heating output in conjunction therewith. Similarly, at the heating end time as shown in FIG. 17, the reference voltage gradually drops after the control signal falls, resulting in a gradually reduction in heating output. Therefore, the consumed power at the start of heating and at the end of heating changes in the same manner as the heating output, so as to realize a so-called "soft start."

In FIG. 14, DC power source 47 is a regulated power supply for supplying a DC power source for voltage detection circuit 54, drive circuit 53, current detection circuit 151, and control circuit 50. Thermistor 6 is disposed in contact with or adjacent to heat-receiving member 30 to detect the temperature of said heat-receiving member 30, and control circuit 50 outputs a fixed voltage control signal when the temperature detected by thermistor 6 is less than a predetermined temperature.

2-3. Third Embodiment

Figure 18:
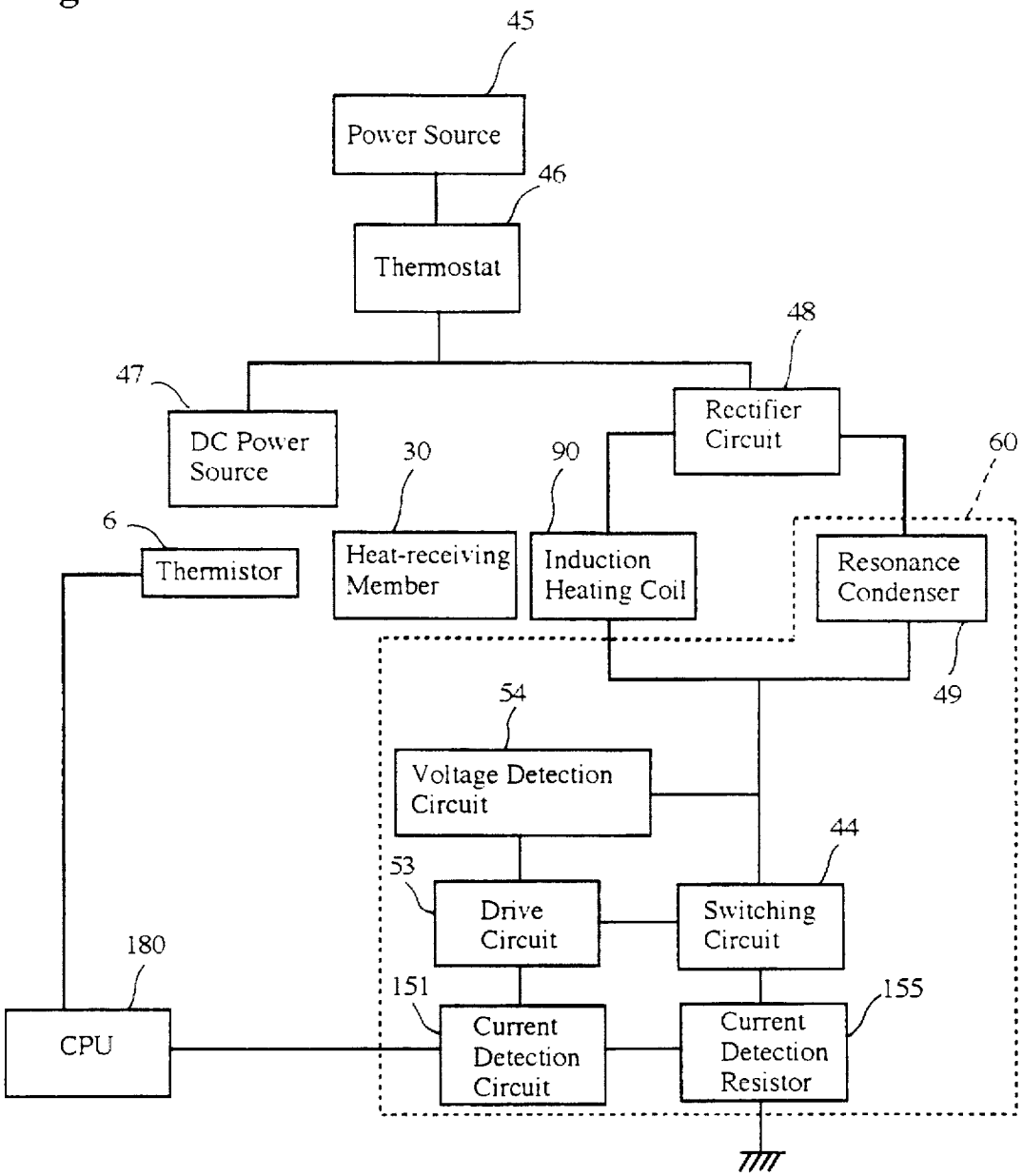
FIG. 18 is a block diagram of a third embodiment of a drive circuit for executing drive control of an induction type heat fixing device.

FIG. 18 is a block diagram of the drive circuit of a third embodiment.

In the drive circuit of FIG. 18, a microcomputer 180 is substituted for the control circuit 50 and time constant circuit 170 of the drive circuit of FIG. 14. In other respects construction is identical to that shown in FIG. 14 and is omitted from further discussion.

Figure 19:
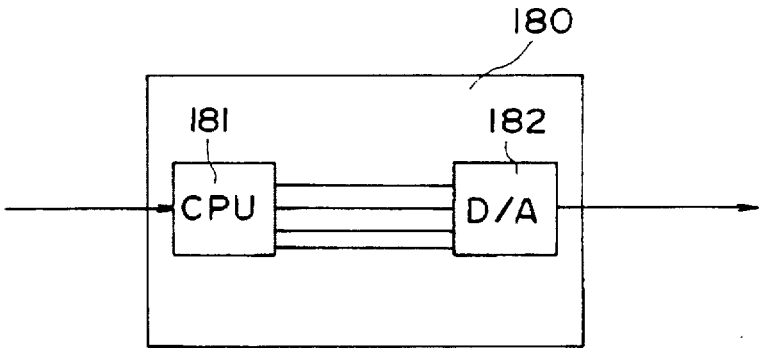
FIG. 19 is a block diagram showing the internal construction of a microcomputer used in the drive circuit of FIG. 18.
Figure 20:
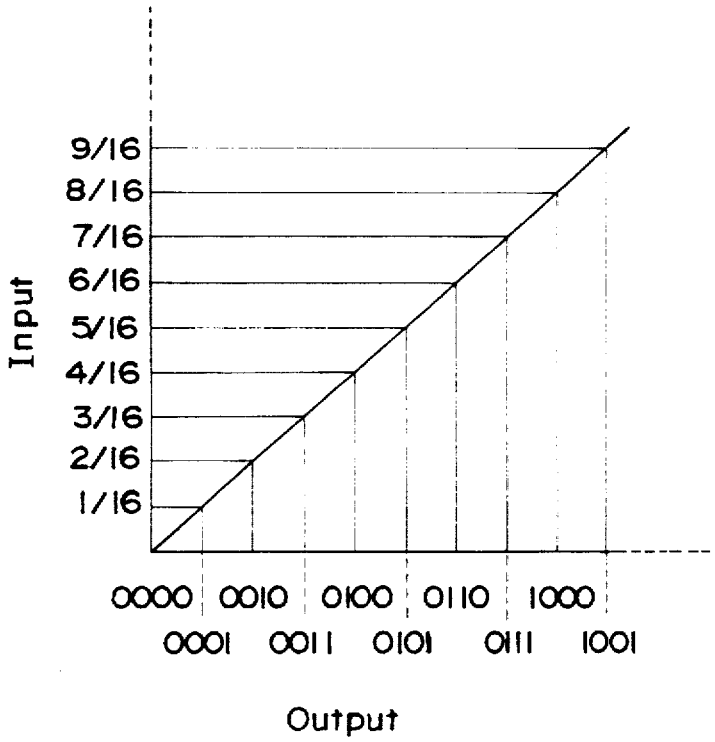
FIG. 20 illustrates the relationship between input and output of the microcomputer of FIG. 19.

Microcomputer 180 comprises, as shown in FIG. 19, a central processing unit 181 (hereinafter referred to as "CPU 181") and digital/analog (D/A) converter 182, wherein CPU 181 outputs as digital signals the signal which are received from thermistor 6, and said digital signals are converted to an analog voltage by D/A converter 182. Specifically, CPU 181 converts the signals received from thermistor 6 to 4-bit digital signals, as shown in FIG. 20, when the value of the input signal from thermistor 6 exceeds a predetermined value, i.e., when the temperature of heat-receiving member 30 drops below a predetermined temperature. These digital signals are sequentially output and converted to analog signals by D/A converter 182 and output from an output port so as to gradually increase the reference voltage.

Figure 21:
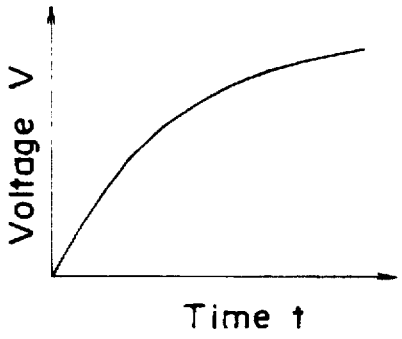
FIGS. 21(*a*), 21(*b*), 21(*c*) and 21(*d*) are drawings for comparing the change of standard voltage in the drive circuit of FIG. 18 and the change of the reference voltage in the drive circuit of FIG. 14.
Figure 21:
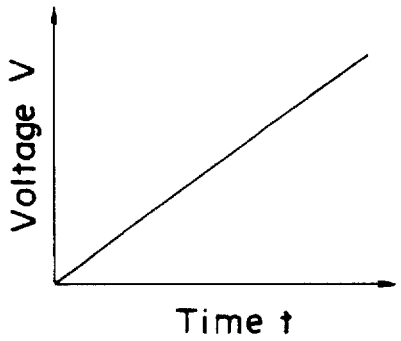
Figure 21:
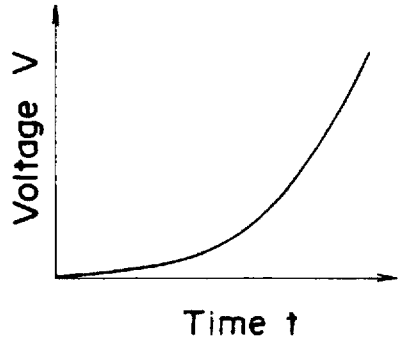
Figure 21:
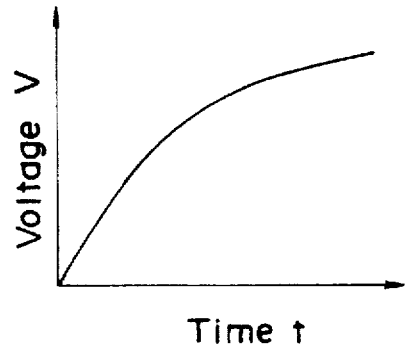

Therefore, when microcomputer 180 is used, it is possible to regulate an optional rate of change of the reference voltage, as shown in FIG. 21(*a*) through 21(*c*) by changing the output timing of the digital value output by CPU 181. When a time constant circuit is used as in the second embodiment, the rate of change is dependent on the CR discharge characteristics, as shown in FIG. 21(*d*) pursuant to the previously mentioned Equation 10.

2-4. Fourth Embodiment

Figure 22:
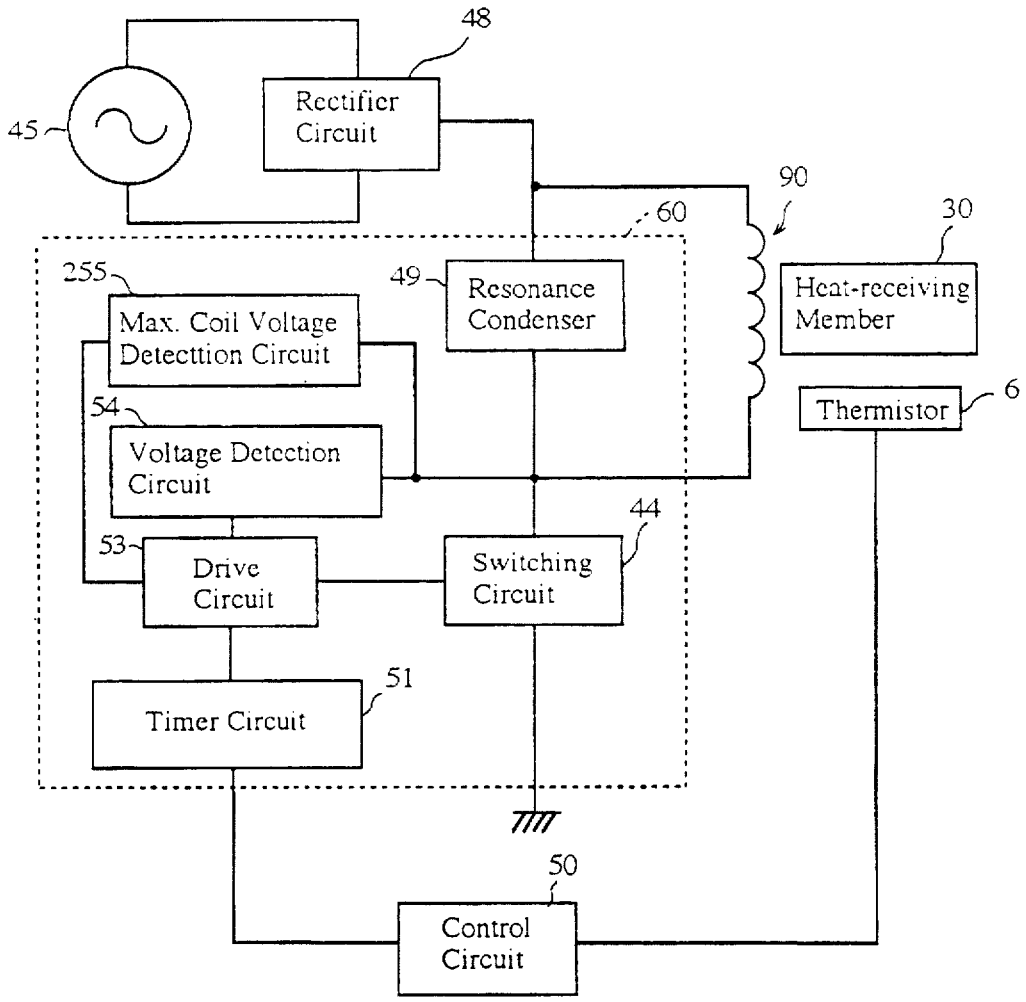
FIG. 22 is a block diagram of a fourth embodiment of a drive circuit for executing drive control of an induction type heat fixing device.

FIG. 22 is a block diagram of the drive circuit of an induction type heat fixing device of a fourth embodiment.

In the drive circuit of the fourth embodiment, the alternating current of commercial power source 45 is rectified to a direct current by rectification circuit 48, converted to a high frequency current by inverter circuit 60, and supplied to induction heating coil 90, in the same manner as the drive circuit of the previous embodiments.

The frequency of the high frequency current supplied to induction heating coil 90 is determined by the switching operation of switching circuit 44 in the same manner as the previous embodiment. The ON timing of switching circuit 44 is determined by the voltage detection circuit 54, and the OFF timing of switching circuit 44 is determined by timer circuit 51.

When the voltage detection circuit 54 detects a drop in the voltage generated by resonance of the induction heating coil 90 and resonance condenser 49 below a constant voltage value, i.e., detects the attainment of 0 V, said voltage detection circuit 54 outputs a signal to drive circuit 53, which turns ON switching circuit 44 by means of said signal. Thus, the ON timing of switching circuit 44 is determined.

On the other hand, timer circuit 51 is a simple circuit comprising a resistor and condenser, wherein said condenser is caused to discharge by means of a control signal input from a control circuit described later, and after a predetermined time determined by the CR discharge characteristics, an OFF signal is output to drive circuit 53. Drive circuit 53 turns OFF switching circuit 44 via the aforesaid OFF signal. Thus, the OFF timing of switching circuit 44 is determined.

A high frequency current is supplied to induction heating coil 90 via the aforesaid switching operation, so as to heat the heat-receiving member 30 via an induction current generated therein.

Control circuit 50 outputs to timer circuit 51 constant voltage ON/OFF signals to maintain the temperature of heat-receiving member 30 at a temperature necessary to accomplish fixing based on the temperature detected by thermistor 6 which is disposed in contact with or adjacent to said heat-receiving member 30.

In this drive circuit, a maximum coil voltage detection circuit 255 is provided to detect the maximum value of the coil voltage in order to prevent overheating of the heat-receiving member 30. Maximum coil voltage detecting circuit 255 detects the maximum value (peak voltage of each cycle of the applied high frequency current) of the coil voltage, and outputs a signal (high level signal) to drive circuit 53 when the detected value exceeds a predetermined reference voltage; this signal is set at low level (OFF) when the maximum value of the coil voltage is less than a predetermined reference value, and drive circuit 53 turns OFF the switching circuit 44. The operation of inventer circuit 60 is completely stopped at the moment a signal transmitted from maximum coil voltage detection circuit 255 to drive circuit 53 is turned OFF, the high frequency current supplied to induction heating coil 90 is interrupted, and overheating of the heat-receiving member 30 is prevented.

The operation for preventing overheating of the heat-receiving member 30 is described below.

Heat-receiving member 30 formed of a metallic member possesses characteristics for elevating the metal resistance by temperature elevation via induction heating. The rate of change of resistance due to such temperature elevation is expressed by Equation 12 below.

$$\text{Resistance rate of change } TCR = \frac{\Delta R}{R_0} \times \frac{1}{\Delta T} \tag{12}$$

In the equation, $\Delta R$ represents change of resistance, $R_0$ represents the resistance value at a reference temperature (e.g., room temperature), $\Delta T$ represents the change of temperature.

The heating output W of heat-receiving member 30 is expressed by Equation 13 below.

$$\begin{aligned} W &= \frac{V_2^2}{R_T} \\ &= \frac{V_2^2}{R_0 + \Delta R} \\ &= \frac{V_2^2}{R_0} \times \frac{1}{1 + TCR \times \Delta T} \end{aligned} \tag{13}$$

In the equation, V2 represents the induction voltage of heat-receiving member 30, and $R_T$ represents the resistance value of heat-receiving member 30 at the current temperature.

The heating output W of the heat-receiving member 30 is proportional to the power accumulated in induction heating coil 90, whereas the power accumulated in induction heating coil 90 is the same value as the power accumulated in the resonance condenser comprising the resonance circuit together with induction heating coil 90 only during the time switching circuit 44 is turned ON, and is expressed by Equation 14 below.

$$\frac{1}{2} C_1 V_1^2 = \frac{1}{2} L_1 I_1^2 \propto W \tag{14}$$

In the equation, $C_1$ represents the capacity of resonance condenser 49, $V_1$ represents the value of the voltage supplied to induction heating coil 90, $L_1$ represents the inductance of induction heating coil 90, and $I_1$ represents the coil current.

When modified by substituting Equation 13 for W in Equation 14, the following Equation 15 is derived.

$$V_1 \propto \frac{1}{\sqrt{1 + TCR \times \Delta T}} \tag{15}$$

Figure 23:
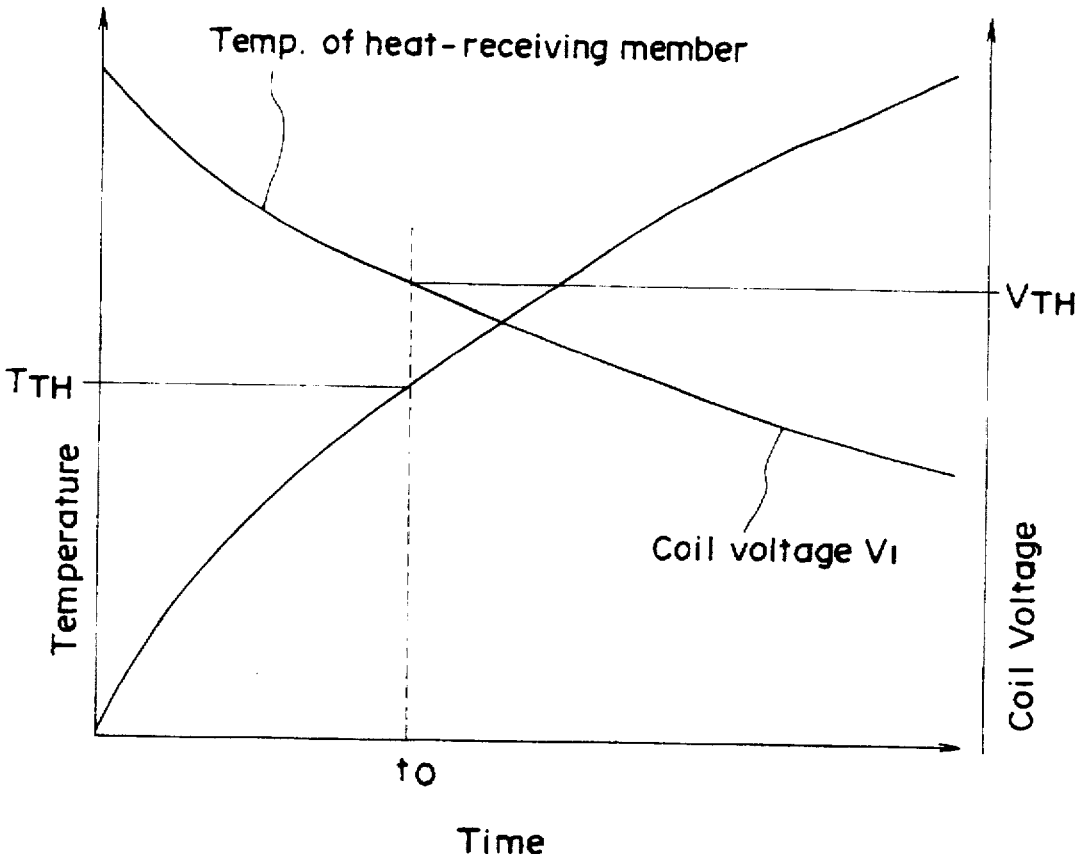
FIG. 23 is a graph showing the relationships among heat-receiving member temperature and time passage, and induction coil voltage and time passage when said heat-receiving member is subjected to induction heating by the induction coil.

The coil voltage $V_1$ from Equation 15 is inversely proportional to the temperature of heat-receiving member 30. That is, when the temperature of heat-receiving member 30 rises, the coil voltage drops, as shown in FIG. 23.

Accordingly, the reduced coil voltage accompanying the rise in temperature of the heat-receiving member 30 is detected, and power is interrupted when the coil voltage drops below a particular constant value $V_{TH}$, thereby preventing a heating temperature rise of heat-receiving member 30 above a temperature $T_{TH}$. That is, in the mode of the present embodiment, maximum coil voltage detection circuit 255 detects coil voltage $V_1$, and outputs an ON signal to drive circuit 53 if the detected voltage is greater than $V_{TH}$, or cuts the ON signal when the detected voltage is less than $V_{TH}$, so as to prevent overheating when the temperature of heat-receiving member 30 attains an abnormally high temperature. Furthermore, the detected coil voltage $V_1$ is a maximum voltage value of the high frequency current supplied via the inventer circuit.

Figure 24:
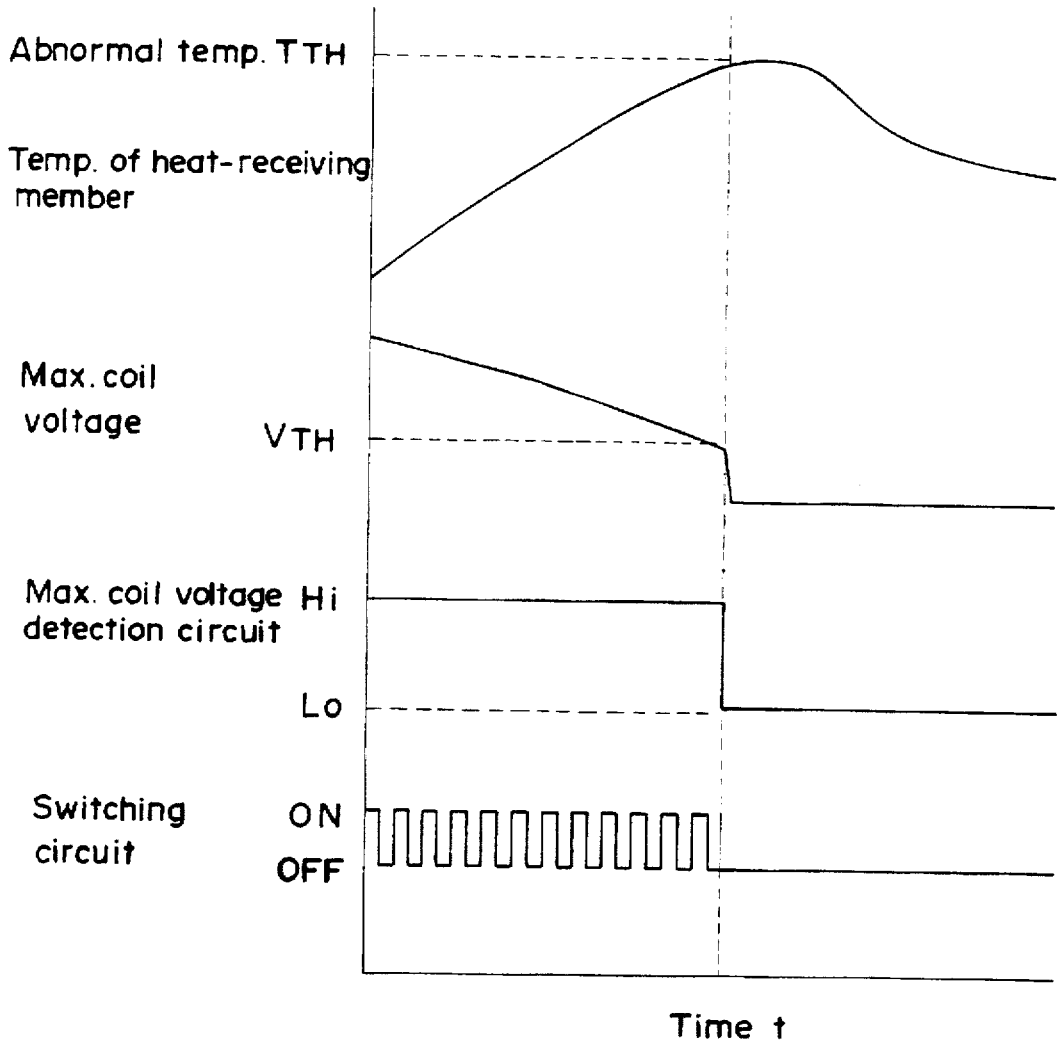
FIG. 24 is a timing chart showing the operation timing for induction heating via the drive circuit of FIG. 22.

This operation is described now with reference to the timing chart of FIG. 24. When the temperature of heat-receiving member 30 exceeds abnormal temperature $T_{TH}$ for whatever reason, the maximum value of the coil voltage, which drops in conjunction with the temperature rise of heat-receiving member 30, is reduced by reference voltage $V_{TH}$. Thus, the high level signal transmitted from maximum coil voltage detection circuit 255 is set to a low level signal, and the output from drive circuit 53 stops and switching circuit 44 is turned OFF. Thus, the operation of inventer circuit 60 stops completely, and heat-receiving member 30 is not heated to a higher temperature because the high frequency current is not supplied to induction heating coil 90.

2-5. Fifth Embodiment

Figure 25:
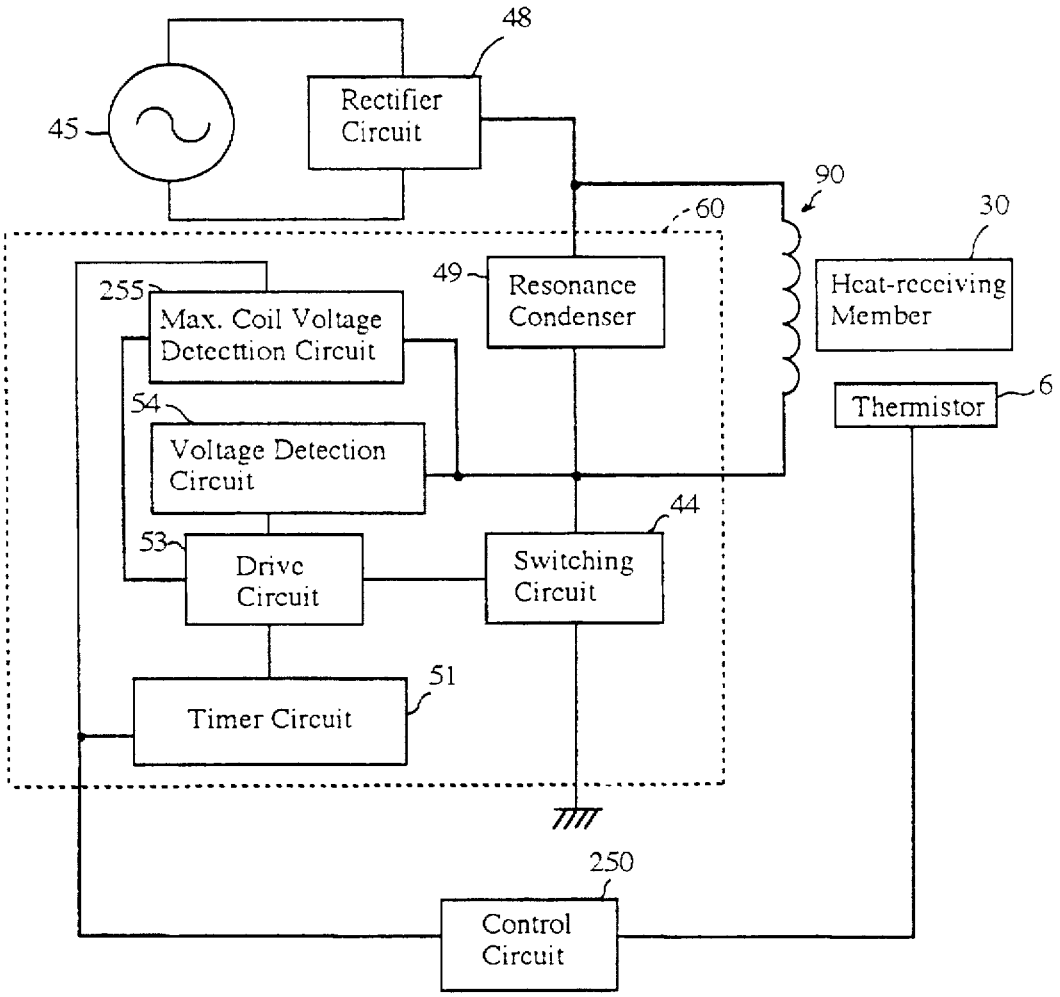
FIG. 25 is a block diagram of a fifth embodiment of the drive circuit for executing drive control of an induction type heat fixing device.

FIG. 25 is a block diagram of the drive circuit of an induction type heat fixing device of a fifth embodiment.

In the drive circuit of FIG. 25, control circuit 250 is capable of optional control of the heating output by changing analog voltage output in contrast to the fixed voltage output of output signals transmitted from control circuit 50 to timer circuit 51 in the fourth embodiment of FIG. 22.

That is, the amount of the load accumulated by the condenser is changed by the voltage supplied to timer circuit 51 comprising a resistor and condenser, thereby changing the timing of the timer circuit which is determined by the CR discharge characteristics. Thus, the time period of OFF timing of switching circuit 44 is changed, so as to change the heating output by changing the amount of power accumulated by induction heating coil 90. if the control signal voltage increases, the OFF timing output from timer circuit 51 is delayed, and the amount of power accumulated by induction heating coil 90 increases, thereby increasing the heating output. On the other hand, if the control signal voltage decreases, the OFF time is conversely reduced, so as to reduce the heating output.

The maximum value of the coil voltage also changes in conjunction with the aforesaid heating output control. In this driving circuit, relative to the voltage value detected by maximum coil voltage detection circuit 255, the reference voltage is set so as to be proportional to the control signal voltage value to prevent overheating of the heat-receiving member 30.

When the control signal voltage is low, the reference voltage is set low to reduce the maximum value of the coil voltage relative to abnormal temperature causing overheating. Conversely, when the control signal voltage is high, the reference voltage is also set high.

Maximum coil voltage detection circuit 255 compares the maximum value of the detected coil voltage with a preset reference voltage, and sets a low level signal for output to drive circuit 53 when the maximum value of the coil voltage is lower than said reference voltage, so as to stop the operation of the inverter circuit 60. Thus, overheating of heat-receiving member 30 is prevented in the sam manner as in the previously described fourth embodiment.

In other respects of operation and construction, the fifth embodiment is identical to the fourth embodiment, and further discussion is therefore omitted.

2-6. Sixth Embodiment

Figure 26:
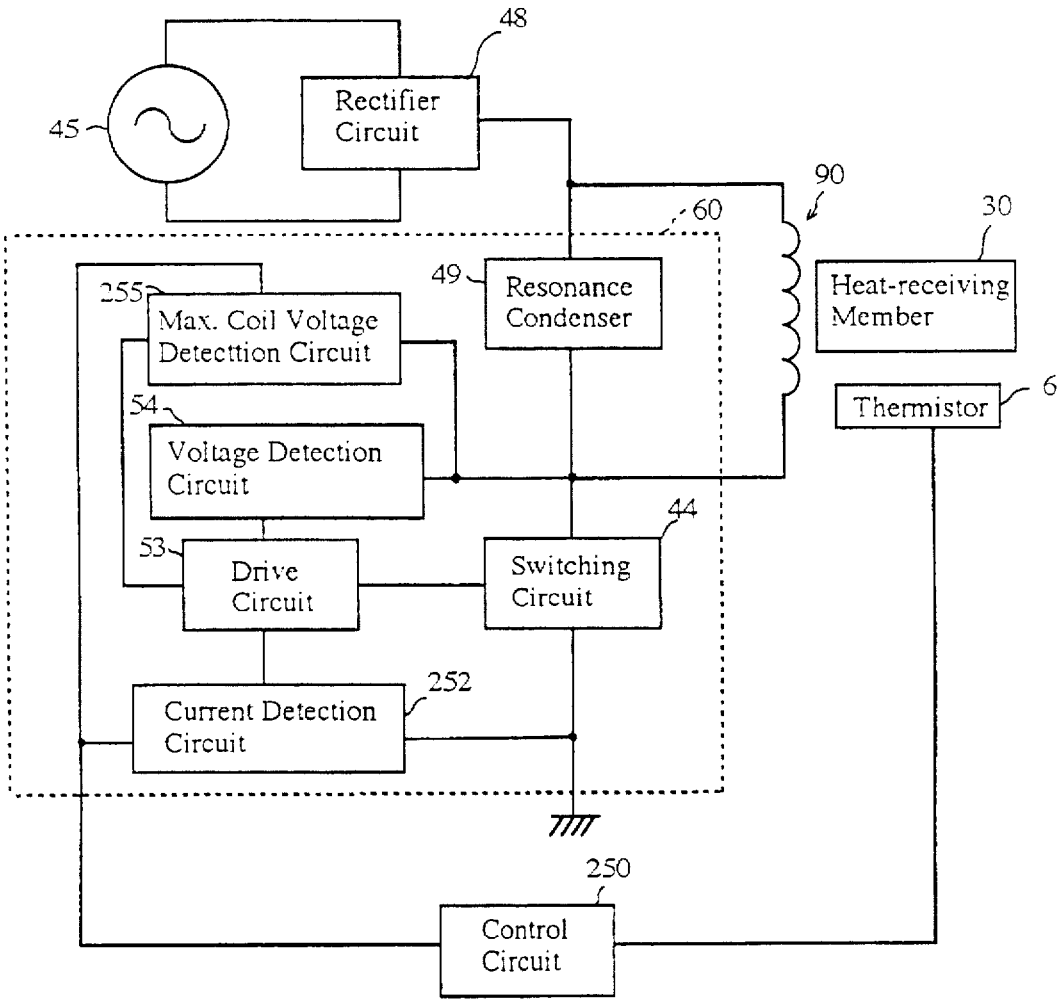
FIG. 26 is a block diagram of a sixth embodiment of the drive circuit for executing drive control of an induction type heat fixing device.

FIG. 26 is a block diagram of the drive of the induction type heat fixing device of a sixth embodiment.

Control circuit 250 is capable of optional control of heating output by analog changes of the voltage output from said control circuit 250, in the same manner as the fifth embodiment. The signals output from control circuit 250 are supplied to current detection circuit 252 as a reference voltage for determining the OFF timing.

That is, current flows to induction heating coil 90 by turning ON switching circuit 44. The value of this current is detected by current detection circuit 251 which detects the voltage produced by the internal current detection resistance When the detected voltage exceeds the voltage value of the control signal output from control circuit 250, a signal is output to drive circuit 53 to turn OFF switching circuit 44. Thus, switching circuit 44 is turned OFF via the aforesaid signal.

Accordingly, if the control signal voltage increases, the time period of the OFF timing output from current detection circuit 252 is increased, the amount of power accumulated in the induction heating coil 90 increases, thereby increasing the heating output. On the other hand, if the control signal voltage decreases, the period of OFF timing is conversely reduced, thereby reducing heating output.

In other respects of operation and construction, the sixth embodiment is identical to the fifth embodiment, and further discussion is therefore omitted.

2-7. Seventh Embodiment

Figure 27:
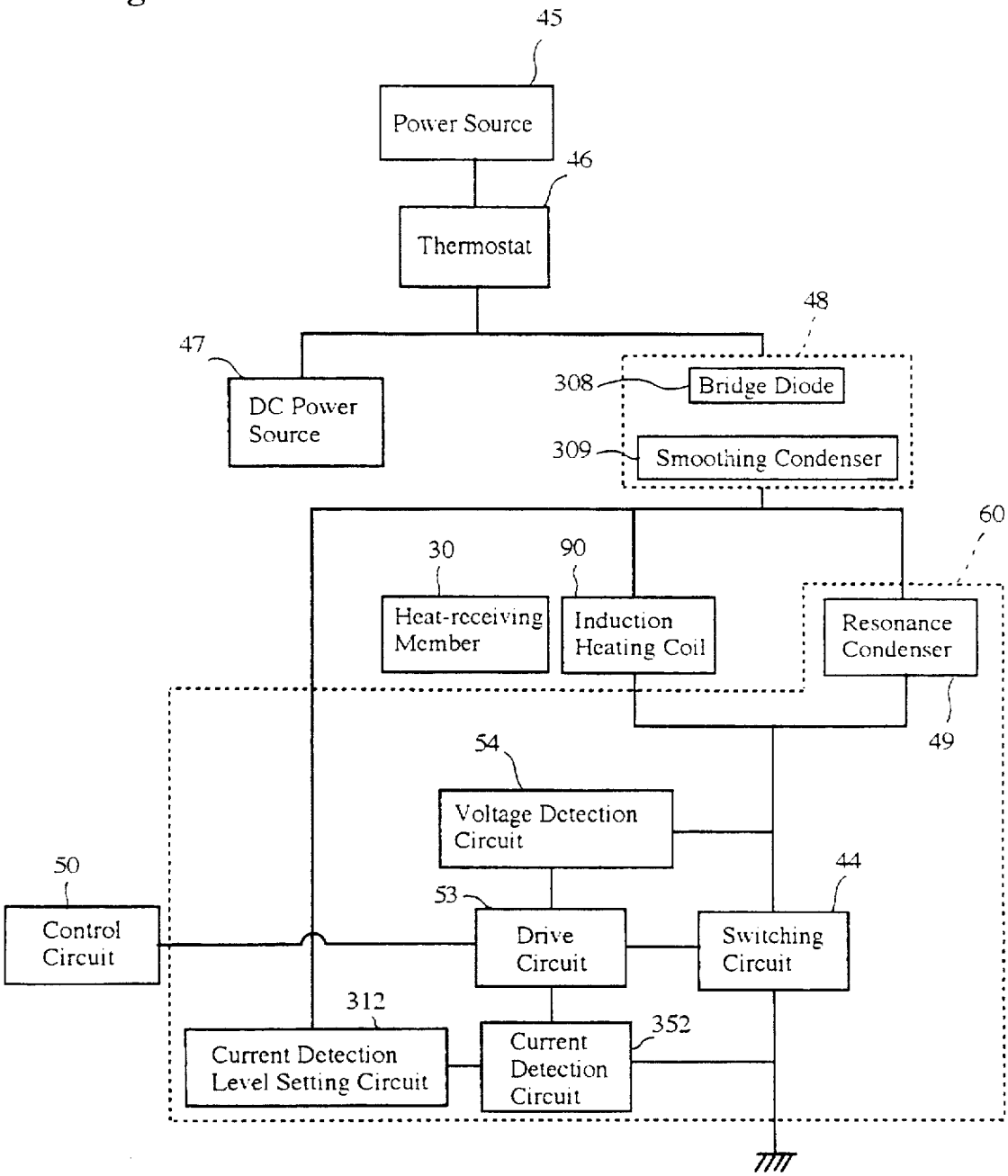
FIG. 27 is a block diagram of a seventh embodiment of the drive circuit for executing drive control of an induction type heat fixing device.

FIG. 27 is a block diagram of the drive circuit of the induction type heat fixing device of a seventh embodiment.

In this drive circuit, the alternating current of a commercial power source (100 V AC) 45 is rectified to a direction current by rectifier circuit 48, and converted to a high frequency current by inverter circuit 60 in the same manner as in previous embodiments. A thermostat 46 is provided as a safety switch in contact with or adjacent to the surface of heat-receiving member 30, and the current supplied to inverter circuit 60 passes through said thermostat 46. When the temperature of heat-receiving member 30 attains an abnormal temperature, the thermostat 46 interrupts the current from the power source.

The 100 V AC high frequency current supplied to induction heating coil 90 is rectified to a direct current by rectifier circuit 48, and is supplied to resonance condenser 49 and induction heating coil 90 which comprise the LC resonance circuit. Rectifier circuit 48 comprises a bridge diode 308 and a smoothing condenser 309. Smoothing condenser 309 uses 10 μF or less in the drive circuit to lower cost and counteract high frequency noise generation produced by the applied high frequency current. In the drive circuit of the present embodiment, a smoothing condenser of, for example, 5 to 10 μF is desirable because the 100 V alternating current from a commercial power source is rectified to a direct current supplied to induction heating coil 90. Furthermore, when the power source voltage is a voltage other than 100 V AC, e.g., 200 V AC, a condenser of 2 to 5 μF is desirable.

Figure 28:
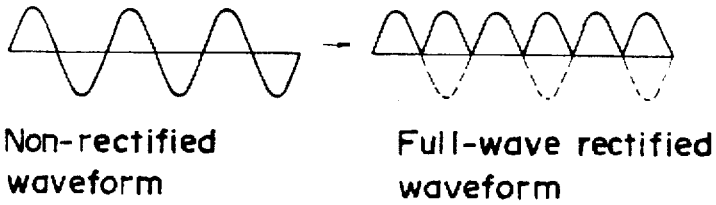
FIG. 28 illustrates an output waveform of a rectifier circuit of the drive circuit of FIG. 27.

Thus, the current supplied from rectifier circuit 48 to the LC resonance circuit comprising induction heating coil 90 and resonance condenser 49 has a full-wave rectified waveform, as shown in FIG. 28.

The high frequency current is supplied by switching, via drive circuit 53, the aforesaid switching circuit 44 connected in parallel with the rectifier circuit 48 and LC resonance circuit. The ON timing of switching circuit 53 is determined by voltage detection circuit 54. Voltage detection circuit 54 detects the voltage of induction heating coil 90, and outputs an ON signal to drive circuit 53 at the moment a predetermined voltage, i.e., 0 V, is attained so as to turn ON switching circuit 44. On the other hand, the OFF timing of switching circuit 44 is determined by current detection circuit 352. Current detection circuit 352 detects the current value of current flowing to induction heating coil 90, and outputs an OFF signal to drive circuit 53 at the moment the set current detection level is attained, said detection level being proportional to the supplied voltage and set by current detection level setting circuit 312, so as to turn OFF switching circuit 44.

A high frequency current is supplied to induction heating coil 90 by means of the aforesaid repeated ON/OFF switching of switching circuit 44, thereby accomplishing induction heating of heat-receiving member 30. That is, the frequency (switching frequency) of the high frequency current supplied to induction heating coil 90 is set by the aforesaid switching operation.

The setting of the current detection level for determining the OFF timing of switching circuit 44 by current detection circuit 352 is described below. The setting of the current detection level is accomplished by current detection level setting circuit 312, wherein current detection level setting circuit 312 detects the output voltage of rectifier circuit 48, i.e., the voltage supplied to the LC resonance circuit, and sets a voltage value proportional to the detected voltage.

Figure 29:
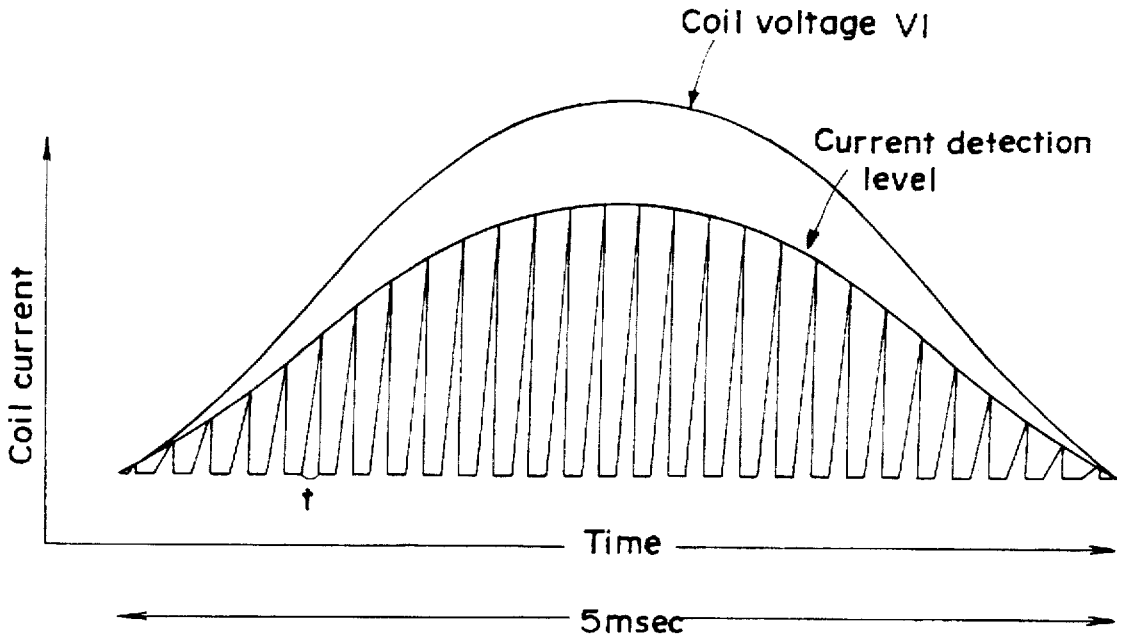
FIG. 29 illustrates a waveform of the high frequency current generated by the drive circuit of FIG. 27.

FIG. 29 illustrates the high frequency current generated by the aforesaid drive circuit, and is an enlargement of the waveform peak of one full-wave rectified waveform. When the voltage supplied to induction heating coil 90 is designated $V_1$, the inductance of induction heating coil 90 is designated $L_1$, the coil current is designated $I_1$, and the switching time is designated t, the following generation Equation 16 is derived.

$$\frac{\Delta I_1}{\Delta t} = \frac{V_1}{L_1} \tag{16}$$

The voltage $V_1$ supplied to induction heating coil 90 is a full-wave rectified waveform, and when the power source voltage amplitude is designated V0, the following Equation 17 is derived.

$$V_1 = V_0|\sin(t)| \tag{17}$$

When Equation 16 is substituted in Equation 17, the following Equation 18 is derived.

$$\Delta I_1 = \Delta t\text{const} = \frac{V_0|\sin(t)|}{L_1\text{const}} \tag{18}$$

Accordingly, when a Δt is constantly maintained which is proportional to the reciprocal of the switching frequency, the following Equation 19 is derived.

$$\Delta I_1 = I_0|\sin(t)| \tag{19}$$

Thus, a Δt can be constantly maintained which is proportional to $\Delta I_1$ and $\Delta V_1$. The value $I_0$ is the amplitude of the coil current detection level.

In the drive circuit of the present embodiment, current detection level setting circuit 312 detects the applied voltage $V_1$ of induction heating coil 90. The reference level $I_{TH}$ of current detection is set by proportional to the detected voltage. The current detection circuit 352 sends a signal to drive circuit 53 to turn OFF switching circuit 44 at the moment when the value of the current flowing to induction heating coil 90 attains the aforesaid reference level $I_{TH}$. Therefore, the a constant frequency is maintained for the high frequency current affecting the induction heating coil 90 even when the coil supplied voltage changes.

In FIG. 27, DC power source 47 is a simple regulated power source which serves as a DC power source for voltage detection circuit 54, drive circuit 53, and current detection circuit 352. Control circuit 50 outputs control signals to maintain the temperature of the heat-receiving member 30 at a temperature necessary for fixing via the temperature detected by thermistor 6 which is disposed in contact with a=or adjacent to said heat-receiving member 30.

Figure 30:
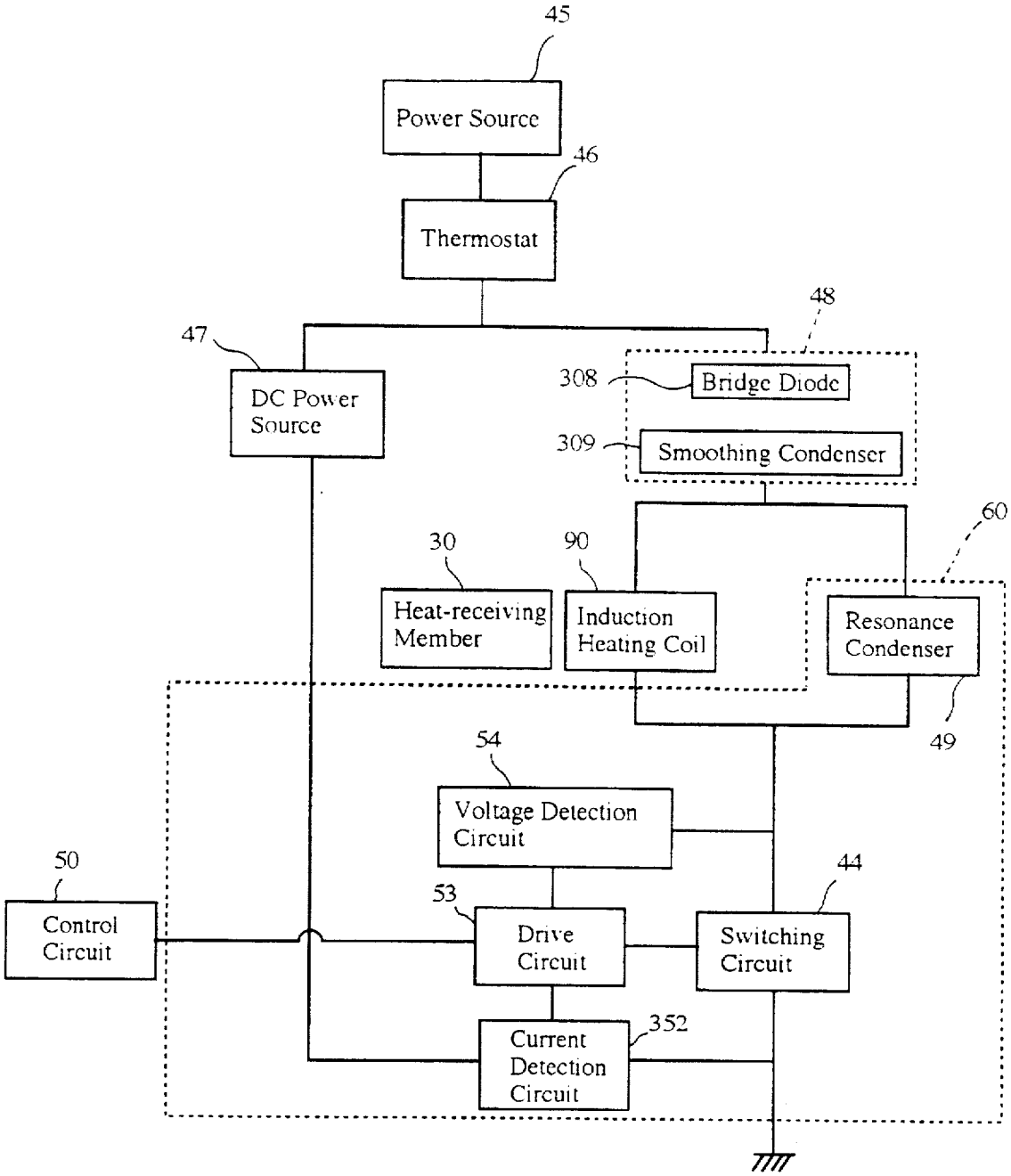
FIG. 30 is a block diagram showing a reference example of a drive circuit for executing drive control of an induction type heat fixing device.

FIG. 30 is a block diagram of a drive circuit of a reference example not using the current detection level setting circuit 312. The ON timing of switching circuit 44 is determined by voltage detection circuit 54 and the OFF timing is determined by current detection circuit 352, in the same manner as the drive circuit of FIG. 27. The current detection level used by the current detection circuit 352 is normally a constant level, and is set by a constant reference voltage supplied from a fixed voltage power source of DC power source 47. In other respects of operation and construction, the drive circuit is identical to the drive circuit of FIG. 27.

Figure 31:
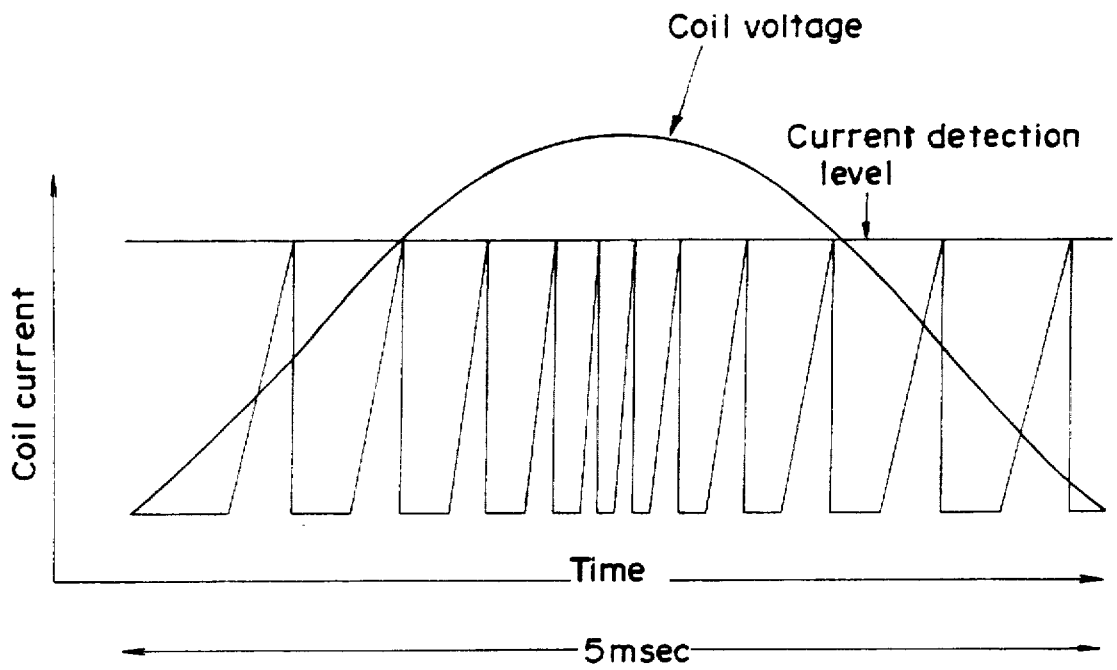
FIG. 31 illustrates a waveform of the high frequency current generated by the drive circuit of FIG. 30.

FIG. 31 shows an enlargement of the peak of a single wave of a full-wave rectified waveform when the reference example drive circuit of FIG. 30 is used. As can be clearly understood from FIG. 31, when a high voltage is supplied to induction heating coil 90, the switching time decreases and frequency increases due to the normally constant current detection reference level, whereas the switching time increases and frequency decreases when a low voltage is supplied to induction heating coil 90; noise in the audible range occurs at under 20 KHz.

Figure 32:
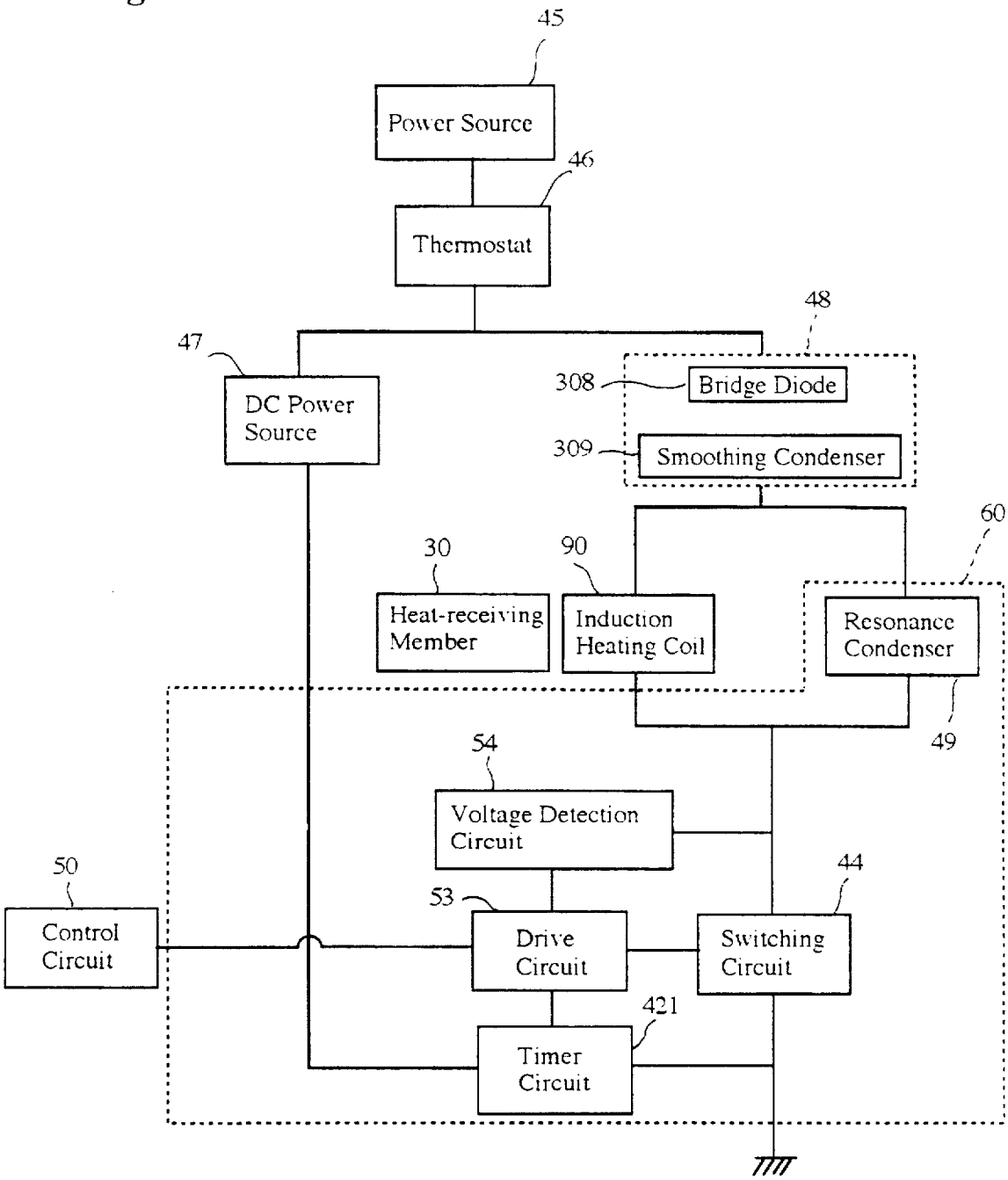
FIG. 32 is a block diagram showing a reference example of a drive circuit for executing drive control of an induction type heat fixing device.

FIG. 32 is a block diagram of a drive circuit of another reference example. in the same manner as the drive circuit of FIG. 27, the ON timing of switching circuit 44 is determined by voltage detection circuit 54; the OFF timing of switching circuit 44 is determined by timer circuit 421 so as to switch OFF the circuit each time a constant time period has elapsed. Timer circuit 421 outputs signals to the drive circuit 53 to turn OFF switching circuit 44 after a uniform time which is proportional to a constant voltage determined by a reference voltage supplied from a DC power source 47 which is a fixed power source unaffected by other components. In other respects of operation and construction, this configuration is identical to the control system of FIG. 27.

In the case of the drive circuit of FIG. 32, the frequency of the coil voltage does not change unlike of the reference example of FIG. 30 because the OFF timing of the switch is always a constant time. Thus, noise is not generated. On the other hand, heating output changes due to the changes in the heat-receiving member 30 characteristics such as resistivity and magnetic permeability and the like accompanying a rise in temperature of the heat-receiving member 30 due to switching unrelated to the coil current, and, therefore, gradually slowing the speed of the temperature rise of the heat-receiving member 30.

Figure 33:
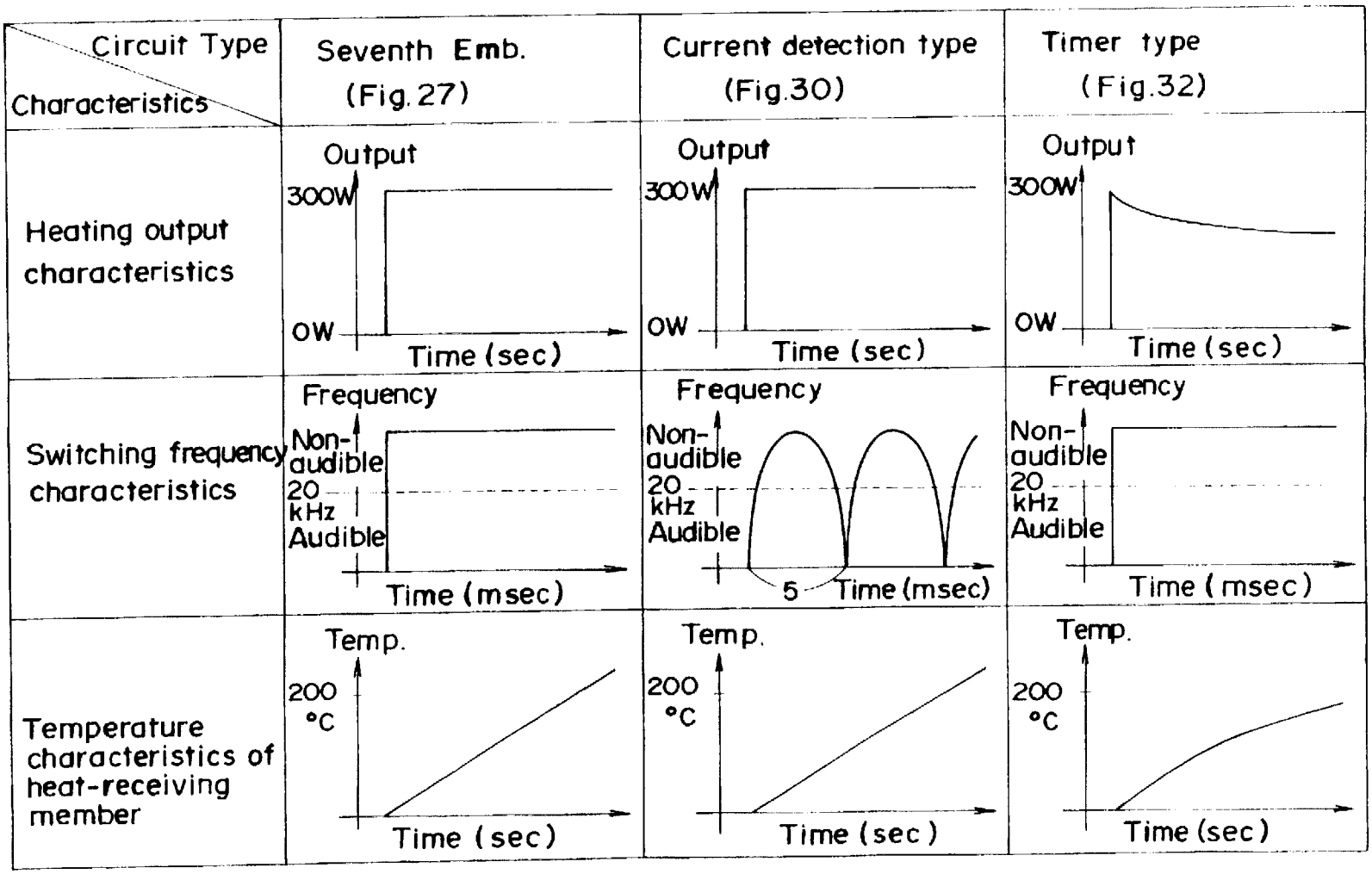
FIG. 33 shows the heating characteristics, switching frequency, and heat-receiving member temperature characteristics of the drive circuits of FIGS. 27, 30, and 32.

FIG. 33 shows the heating output characteristics, switching frequency characteristics, and temperature characteristics of heat-receiving member 30 of the drive circuit of FIG. 27 and the drive circuits of reference examples of FIGS. 30 and 32. As can be understood from the illustration, although heating output characteristics are constant for both the drive circuit of FIG. 27 and the current detection type drive circuit of FIG. 30, heating output gradually decreases for the timer type drive circuit of FIG. 32. The switching frequency characteristics are constant in the non-audible range for the drive circuit of FIG. 27 and the timer type drive circuit of FIG. 32, whereas the frequency fluctuates in the current detection type circuit of FIG. 30 within the audible range (less than 20 KHz). The temperature characteristics of heat-receiving member 30 indicate a uniform elevation in the drive circuit of FIG. 27 and current detection type circuit of FIG. 30, but these characteristics indicate a gradual decreasing rate of elevation in the timer type circuit of FIG. 32. The drive circuit of FIG. 27 provides excellent heating output characteristics, switching frequency characteristics, and temperature characteristics of heat-receiving member 30 compared to the noise generation and deterioration of heating output characteristics in each of the aforesaid reference examples.

2-8. Eighth Embodiment

Although the induction type heat fixing device was developed to reduce warm up time and advance energy conservation, not only is a low thermal capacity heat-receiving member, e.g., fixing roller, required due to the short warm up time, but temperature controls are necessary to reduce temperature levels. Therefore, control to change the heating output are most suitable.

In the present embodiment, switching loss is minimized even when heating output changes as previously described.

Figure 34:
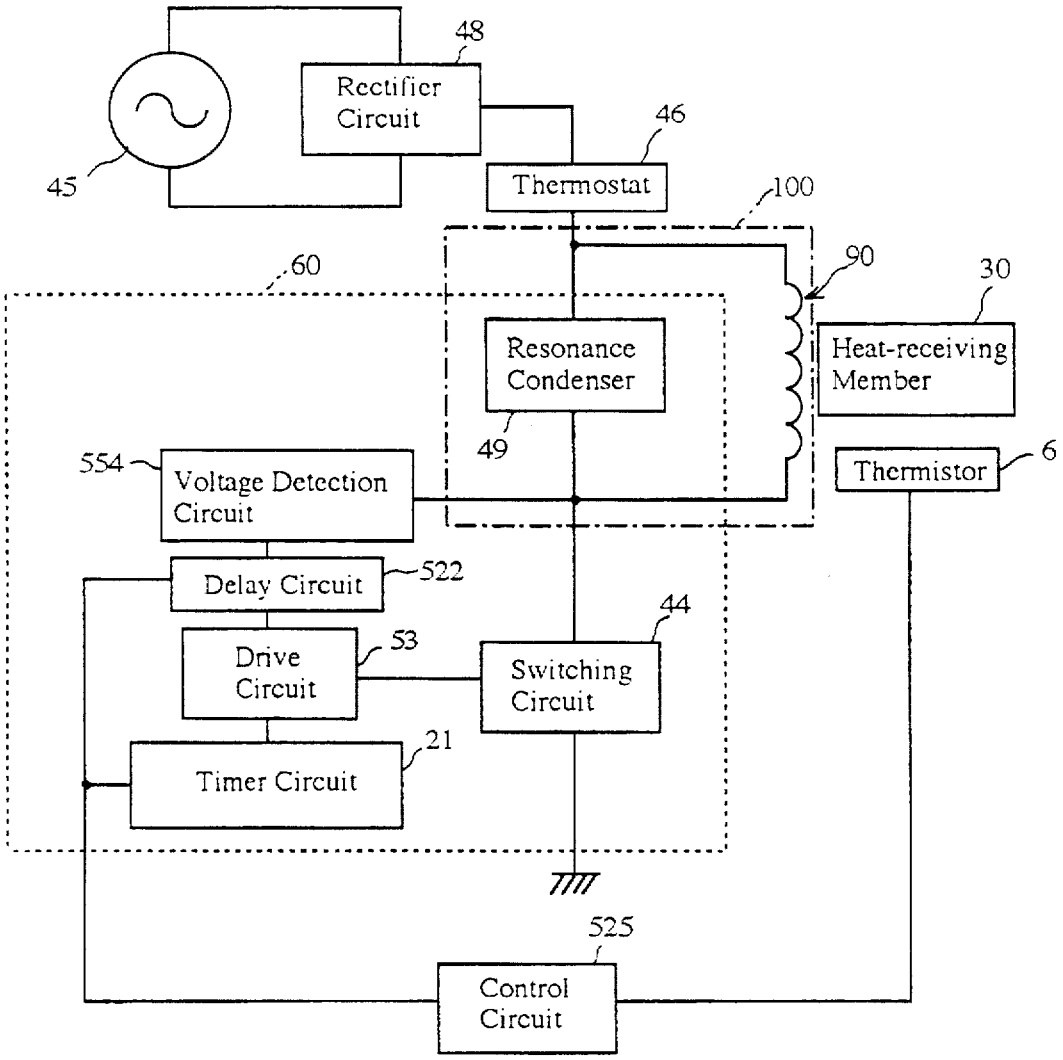
FIG. 34 is a block diagram of an eighth embodiment of the drive circuit for executing drive control of an induction type heat fixing device.

FIG. 34 is a block diagram of a drive circuit of the eighth embodiment.

As in previously described embodiments, rectifier circuit 48 rectifies the AC power source 45 so as to supply a direct current to resonance condenser 49 and induction heating coil 90 via thermostat 46. Rectifier circuit 48 is a bridge circuit utilizing four individual diodes to produce a full-wave current.

Thermostat 46 is a safety switch for interrupting the application of a DC voltage when fixing roller 30 overheats and the like.

Resonance circuit 100 comprises a resonance condenser 49 and induction heating coil 90, and a high frequency resonance current to induction heating coil 90.

Voltage detection circuit 554 detects the voltage $V_1$ supplied by the resonance circuit 100, compares the detected voltage $V_1$ to a reference voltage $V_{ref}$, and outputs a trigger signal to delay circuit 522 to turn ON switching circuit 44 when the voltage $V_1$ is less than the reference voltage $V_{ref}$. This condition is shown by (C) in FIG. 35. In the drawing, the dashed line represents reference voltage $V_{ref}$, and the solid line represents the detected voltage $V_1$. Since reference voltage $V_{ref}$ must be higher than the voltage of AC power source 45, this voltage is set above 141 V when the voltage of AC power source 45 is 100 V , and is set at above 325 V when the power source voltage is 230 V .

Delay circuit 522 operates when voltage detection circuit 54 detects a drop in the voltage VD of resonance circuit 100 below the reference voltage $V_{ref}$, and outputs a signal to drive circuit 53 to turn ON switching circuit 44 when the calculated delay time has elapsed.

This delay time is calculated by delay circuit 522 based on the output control signals output from control circuit 525, i.e., based on signals for setting the output of induction heating coil 90. As shown by (C) in FIG. 35, the delay time is set at Δt1 when the output of induction heating coil 90 is set at 100%, and the delay tine is set at Δt2 when the output of induction coil 90 is set at 30%. This delay time is determined from the change morphology (waveform) of voltage $V_1$ of resonance circuit 100 when induction heating coil 90 output is set at 100% and set at 30%.

When the output of induction heating coil 90 is set at 100%, the voltage $V_1$ of resonance circuit 100 changes as shown at the left side of (C) in FIG. 35, whereas when the voltage $V_1$ of resonance circuit 100 is less than the reference voltage $V_{ref}$, a trigger signal is output from voltage detection circuit 554. In response, delay circuit 522 is operated, and after the elapse of delay time Δt1 calculated based on the output control signal from control circuit 525, a signal is output to turn ON switching circuit 44.

On the other hand, when the output of induction heating coil 90 is set at 30%, the voltage $V_1$ of the resonance circuit 100 changes as shown at the right side of (C) in FIG. 35, and a trigger signal is output from voltage detection circuit 554 when the voltage $V_1$ of resonance circuit 100 is less than the reference voltage $V_{ref}$. In response, delay circuit 522 is operated, and after the elapse of delay time Δt2 calculated based on the output control signal from control circuit 525, a signal is output to turn ON switching circuit 44.

Timer circuit 21 outputs a signal to periodically turn OFF switching circuit 44 at uniform intervals based on output control signals sent from control circuit 525 to set the output of induction heating coil 90. The output control signals are signals to regulate the output from induction heating coil 90, as shown by (A) in FIG. 35, and may be either analog or digital signals.

Drive circuit 53 receives signals to turn ON switching circuit 44 output from delay circuit 522 and signals to turn OFF switching circuit 44 output from timer circuit 21, and operates the ON/OFF switching of switching circuit 44. Therefore, switching circuit 44 receives a square waveform voltage $V_B$ of about 20 to 30 KHz shown ion the left side of the illustration when the induction heating coil 90 output is set at 100% by control output signals from control circuit 525, and receives a square waveform voltage $V_B$ of about 30 to 40 KHz shown on the right side of the illustration when said output is set at 30%.

Inventer circuit 60 comprises resonance condenser 49 and induction heating coil 90, and outputs current $I_1$ having the waveform shown by (B) in FIG. 35 to induction heating coil 90 in accordance with the output of induction heating coil 90 set by control output signals from control circuit 525.

The operation of the circuit of the aforesaid construction is briefly described below.

Timer circuit 21 sets the time for periodically turning OFF switching circuit 44 in accordance with output control signals (the set output of induction coil 90) from control circuit 525. Accordingly, timer circuit 21 outputs signals to turn OFF switching circuit 44 with the set periodicity. As shown in FIG. 35(D), a signal to turn OFF switching circuit 44 is output at a frequency of 20 to 30 KHz when the output control signal is 100%, and a signal to turn OFF switching circuit 44 is output at a frequency of 30 to 40 KHz when the output control signal is 30%. Of curse drive circuit 53 receives these OFF signals and turns OFF switching circuit 44.

When switching circuit 44 is turned OFF by control circuit 53, the energy of $L_1I_1^2/2$ ($L_1$: inductance of induction coil 90; $I_1$:current of induction coil 90) accumulated in induction heating coil 90 moves until satisfying $C_1V^2/2$ ($C_1$: static capacity of resonance condenser 49; V: voltage of resonance condenser 49) of resonance condenser 49, thereby elevating the voltage $V_1$ of resonance circuit 100, as shown by (D) in FIG. 35. When this elevation ends, energy is then received in the opposite direction, and the voltage $V_1$ of resonance circuit 100 begins to drop.

When the output control signal is 100% and the voltage detection circuit 554 detects that the voltage $V_1$ of resonance circuit 100 is less than reference voltage $V_{ref}$, a trigger signal is output to turn ON switching circuit 44.Delay circuit 522 receives this trigger signal, and outputs a signal to turn ON switching circuit 44 to drive circuit 53 when the calculated delay time Δt1 has elapsed. When the output control signal is 30% and voltage detection circuit 54 detects that the voltage $V_i$ of resonance circuit 100 continues to drop below reference voltage $V_{ref}$, a trigger signal is output to turn ON switching circuit 44. Delay circuit 522 receives this trigger signal, and outputs a signal to turn ON switching circuit 44 to drive circuit 53 when a calculated delay time Δt2 has elapsed.

Drive circuit 53 receives the aforesaid signal and turns ON switching circuit 44.

Thus, when the output timing changes for the signals output from delay circuit 522, so as to turn ON switching circuit 44 when voltage $V_1$ of resonance circuit 100 is a minimum value, the waveform of voltage $V_1$ of resonance circuit 100 is smoothed, as shown by (C) in FIG. 35, thereby suppressing switching loss to a minimum limit.

When switching circuit 44 is turned ON, a DC voltage is supplied from rectifier circuit 48 to resonance circuit 100, and energy accumulates in induction coil 90.

Fixing drum 30 is heated to a desired temperature by repeating the previously described operation.

2-9. Ninth Embodiment

Figure 36:
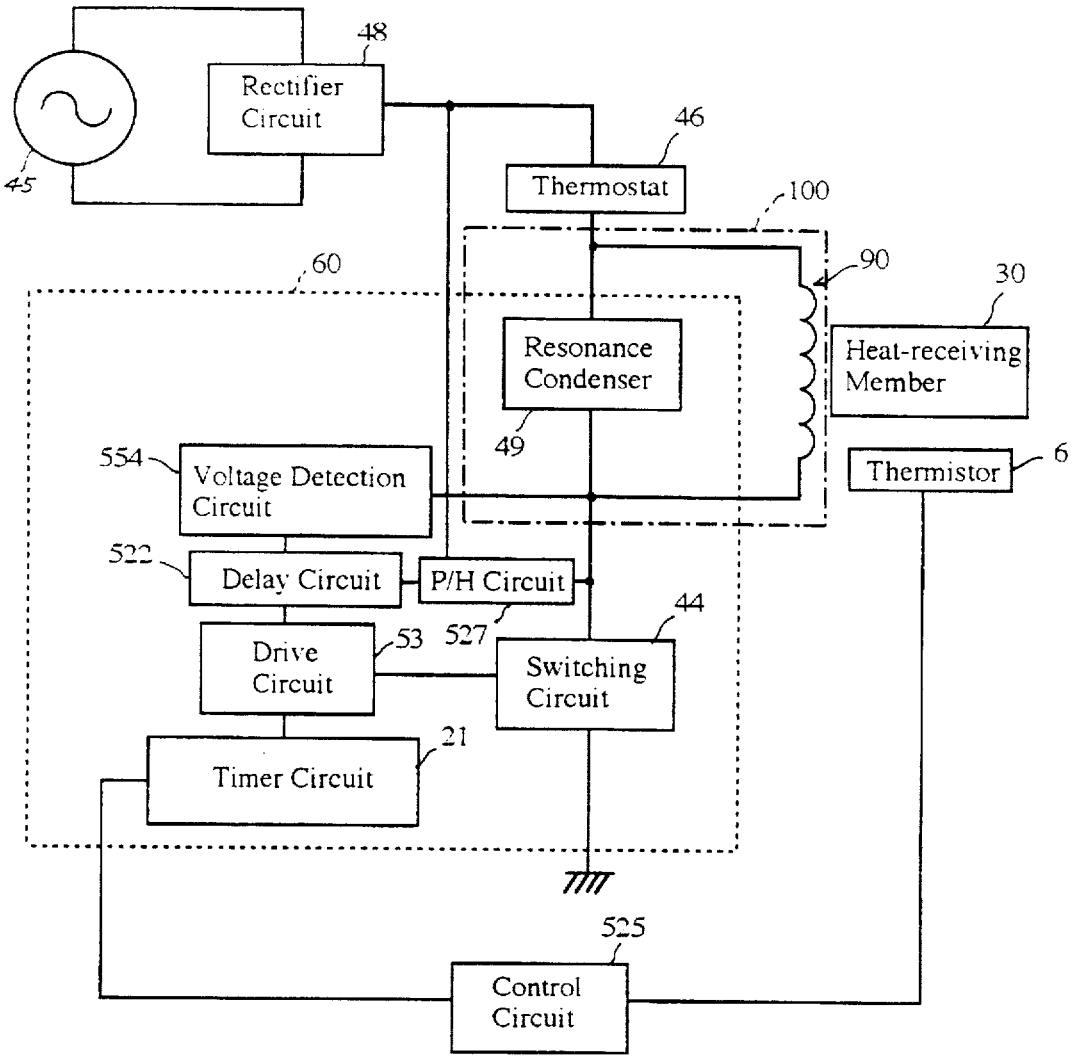
FIG. 36 is a block diagram of a ninth embodiment of the drive circuit for executing drive control of an induction type heat fixing device.

FIG. 36 is a block diagram of a drive circuit of the ninth embodiment. This circuit differs from the circuit of FIG. 34 in that a peak-hold circuit 527 is added, but other components have the same functions as previously described and are, therefore, omitted from discussion.

Peak-hold circuit 527 detects the maximum voltage of resonance circuit 100 at each 1 period of oscillation output by rectifier circuit 48, i.e., each ½ period of AC power source 45.

Figure 35A:
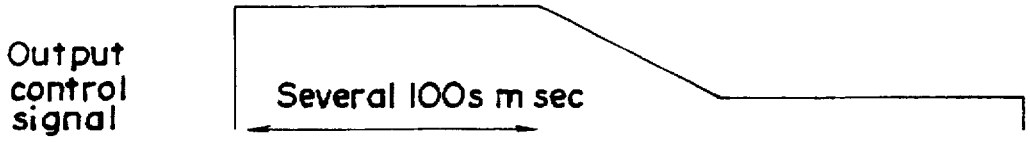
FIG. 35 illustrates an output waveform of each component of the drive circuit of FIG. 34.
Figure 35B:
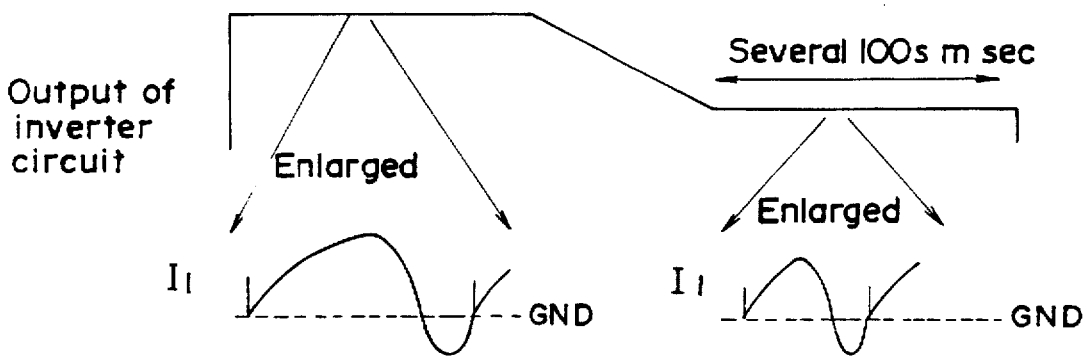
Figure 35C:
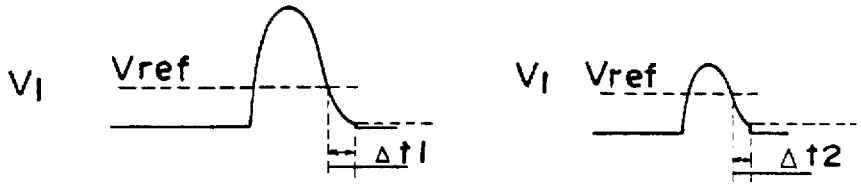
Figure 35D:
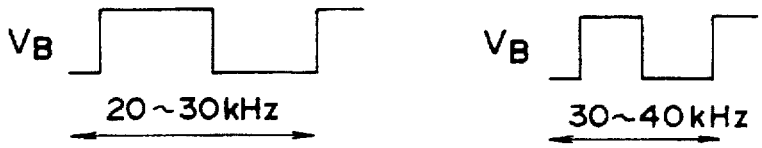

As shown in FIG. 35(C), the maximum value of voltage $V_1$ of resonance circuit 100 changes in accordance with the output control signal output from control circuit 525, i.e., signals which set the output of induction coil 90. For example, when the output of induction coil 90 is set at 100%, the maximum value of voltage $V_1$ increases as shown at the left of (C) in FIG. 35, whereas when the output is set at 30%, the maximum value decreases as shown at the right of (C) in FIG. 35. Since this maximum value changes in accordance with the output of induction coil 90, the output of induction coil 90 can be indirectly adjusted if said maximum value is detected.

Delay circuit 522 operates after voltage detection circuit 54 detects that the voltage VD of resonance circuit 100 has dropped below reference voltage $V_{ref}$, and outputs a signal to turn ON switching circuit 44 to drive circuit 53 when a calculated delay time has elapsed.

This delay time is calculated by delay circuit 522 based on the maximum value of voltage $V_1$ of resonance circuit 100 detected by peak-hold circuit 27. As shown by (C) in FIG. 35, the delay time is set at Δt1 when the maximum value is detected with the output of induction coil 90 is set at 100%, and the delay time is set at Δt2 when the maximum value is detected with the output of induction coil 90 is set at 30%.

When the output of induction coil 90 is set at 100%, the voltage $V_1$ of resonance circuit 100 changes as shown at the left of (C) in FIG. 35. When the voltage $V_1$ of resonance circuit 100 is less than a reference voltage $V_{ref}$, a trigger signal is output from voltage detection circuit 54 to simultaneously actuate delay circuit 522, and a signal to turn ON switching circuit 44 is output after the elapse of the delay time Δt1 calculated based on the maximum value of voltage $V_1$ of resonance circuit 100 detected by peak-hold circuit 527.

On the other hand, when the output of induction coil 90 is set at 30%, the voltages changes as shown at the right of (C) in FIG. 35. When the voltage $V_1$ of resonance circuit 100 is less than the reference voltage $V_{ref}$, a trigger signal is output from voltage detection circuit 54 to simultaneously actuate delay circuit 522, and a signal to turn ON switching circuit 44 is output after the elapse of the delay time Δt2 calculated based on the maximum value of voltage VD of resonance circuit 100 detected by peak-hold circuit 527.

Thus, the output of induction coil 90 is indirectly detected from the maximum voltage value of resonance circuit 100. When the output timing changes for the signals output from delay circuit 522 to as to turn ON switching circuit 44 when voltage VD os resonance circuit 100 is a minimum, the waveform of voltage $V_1$ os resonance circuit 100 is smoothed as shown by (C) in FIG. 35, and switching loss is reduced to a minimum limit.

2-10. Tenth Embodiment

Figure 37:
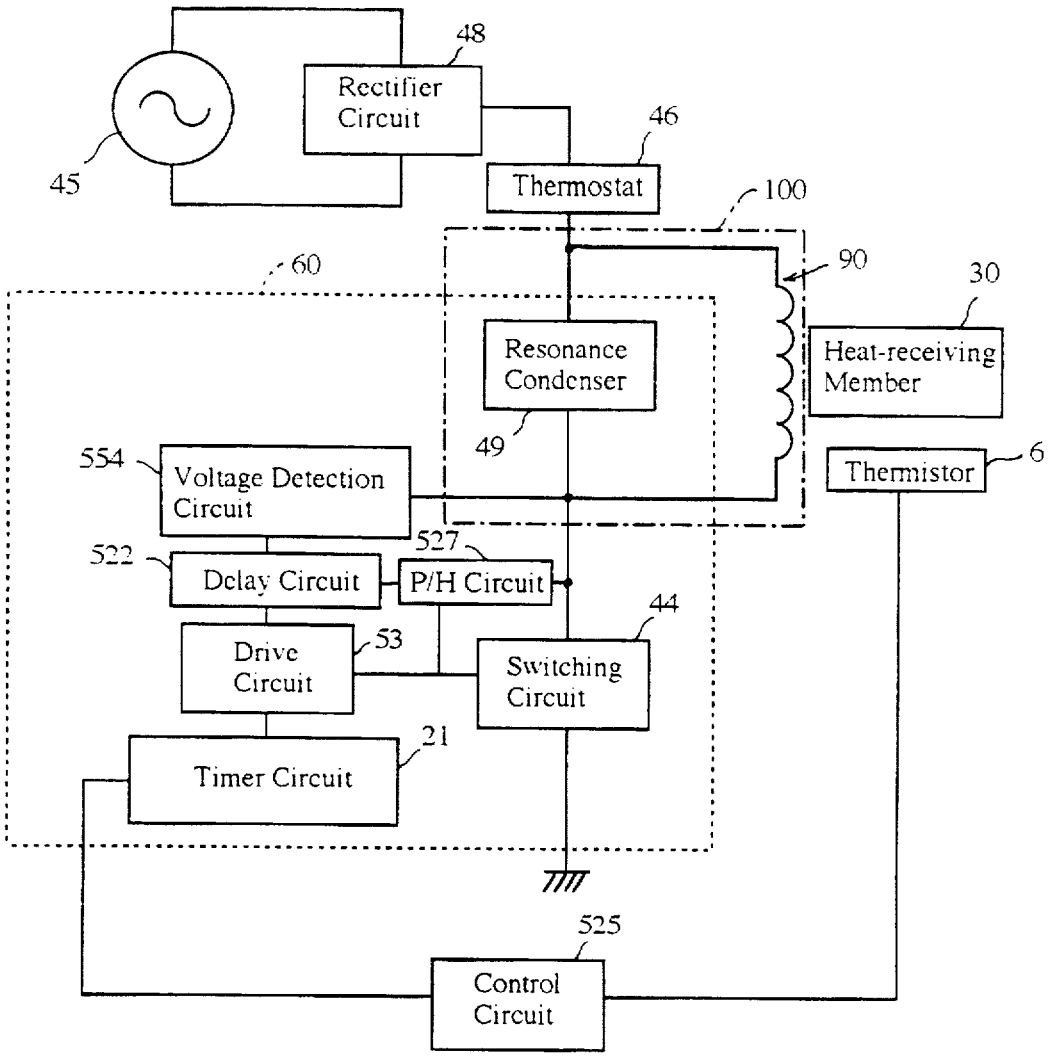
FIG. 37 is a block diagram of a tenth embodiment of the drive circuit for executing drive control of an induction type heat fixing device.

FIG. 37 is a block diagram of a drive circuit of a tenth embodiment. This circuit differs from the circuit of FIG. 36 only insofar as the sampling period of peak-hold circuit 27 is accomplished by the ON period of switching circuit 44.

In other respects of circuit operation and circuit construction, this configuration is identical to the circuit of FIG. 36, and further discussion is, therefore, omitted.

As previously described, the detection of the maximum value of voltage $V_1$ occurs before switching circuit 44 is turned ON at an optimum timing unrelated to output, such that the energy remaining in induction coil 90 does not escape when switching circuit 44 is turned ON. If, experimentally, the switching loss is 5.6 W when the reference voltage $V_{ref}$ is set at 200 V, the power source voltage is 100 V AC, the delay time Δt1 is set at 7 μsec when induction coil output is 100%, and the delay time Δt2 is set at 4 μsec when the induction coil 90 output is 30%. Since, conventionally, the switching loss is 8.3 W when delay time Δt1 is set at 7 μsec regardless of the output of induction coil 90 under identical conditions of power source output and reference voltage, it is clear that the switching loss is reduced 2.7 W by the effects of the present invention. Furthermore, a virtually identical reduction of switching loss was observed when the delay time Δt1 was set at 10 μsec with 100% induction coil output, and delay time Δt2 was set at 7 μsec with 30% induction coil output when the reference voltage $V_{ref}$ was set at 400 V using a power source voltage of 230 V AC.

Although the present invention has been fully described by way of examples with reference to the accompanying drawings, it is to be noted that various changes and modifications will be apparent to those skilled in the art. Therefore, unless otherwise such changes and modification depart from the scope of the present invention, they should be construed as being included therein.

What is claimed is:

1. A fixing device which used in an image forming apparatus for fixing a toner image on a sheet, said fixing device comprising:

a driving circuit which produces a high frequency current from an electric power of a power source and supplies the high frequency current to a coil so as to generate an induction current in a heat-receiving member and heat said heat-receiving member;

wherein said driving circuit includes:

a detection means for detecting an amount of voltage fluctuation of said power source, and a compensation means that controls the high frequency current supplied to said coil in accordance with the voltage fluctuation amount detected by said detection means for compensating the voltage fluctuation.

2. The fixing device as claimed in claim 1, wherein said detection means has a first voltage source that generates a first reference voltage having a constant voltage level independent from the voltage fluctuation of said electric power source and a second voltage source that generates a second reference voltage having a variable voltage level that varies according to the voltage fluctuation of said electric power source, and wherein said compensation means controls the high frequency current supplied to said coil in accordance with a voltage difference between the first and second reference voltages for compensating the voltage fluctuation of said electric power source.

3. The fixing device as claimed in claim 2, wherein said compensation means varies the frequency of the high frequency current.

4. The fixing device as claimed in claim 3, wherein said driving circuit further includes a switching circuit which switches a current supply to said coil between a supply state and an interrupted state to generate the high frequency current to said coil, and wherein said compensation means comprises a timer circuit which determines a time period for the supply state of said switching circuit to control the frequency of the high frequency current.

5. The fixing device as claimed in claim 4, wherein said driving circuit further includes a voltage detection circuit which detects the voltage supplied to said coil and determines a time period for the interrupted state of said switching circuit.

6. A fixing device used in an image forming apparatus for fixing a toner image on a sheet, said fixing device comprising:

a heat-receiving member comprised of a metal conductive member for generating heat and thermally fusing the toner image on the sheet;

a coil which is arranged near said heat-receiving member; and a driving circuit which produces a high frequency current and supplies the high frequency current to said coil so as to generate an induction current in said heat-receiving member and heat said heat-receiving member, said driving circuit gradually increasing an electric power of the high frequency current supplied to said coil at start of heating, wherein said driving circuit includes a switching circuit that switches a current supply to said coil between a supply state and an interrupted state to generate the high frequency current to said coil, and a time period for the supply state of said switching circuit is gradually increased at the start of heating to increase the electric power of the high frequency current supplied to said coil.

7. The fixing device as claimed in claim 6, wherein said driving circuit further includes;

a current detection circuit which detects the amount of the high frequency current flowing to said coil and causes said switching circuit to switch from the supply state to the interrupted state when the detected amount exceeds a reference value, and a reference value generating circuit which generates said reference value and gradually increases the reference value at the start of heating.

8. The fixing device as claimed in claim 7 wherein said reference value generating circuit including a time constant circuit having a resistor and a condenser.

9. The fixing device as claimed in claim 7 wherein said reference value generating circuit including a microprocessor.

10. A fixing device being used in an image forming apparatus for fixing a toner image on a sheet, said fixing device comprising:

a heat-receiving member comprised of a metal conductive member for generating heat and thermally fusing the toner image on the sheet;

a coil which is arranged near said heat-receiving member; and a driving circuit which produces a high frequency current and supplies the high frequency current to said coil so as to generate an induction current in said heat-receiving member and heat said heat-receiving member;

wherein said driving circuit includes a detection circuit which detects the maximum value of the voltage supplied to said coil and prevents said driving circuit from supplying the high frequency current to the coil for preventing overheating of the heat-receiving member when the detected maximum value drops below a predetermined value.

11. The fixing device as claimed in claim 10 further comprising a control means for controlling an electric power of the high frequency current supplied to said coil, wherein said predetermined value is varied in accordance with the electric power controlled by said control means.

12. The fixing device as claimed in claim 11 wherein said driving circuit includes a switching circuit which switches a current supply to said coil between a supply state and an interrupted state to generate the high frequency current to said coil, and a timer circuit which determines a time period for the supply state of said switching circuit, and said control means outputs a control signal to said timer circuit for changing said time period for the supply state.

13. A fixing device as claimed in claim 11, wherein said driving circuit includes a switching circuit which switches a current supply to said coil between a supply state and an interrupted state to generate the high frequency current to said coil, and a current detection circuit which detects the current value flowing to said coil and generates a signal to cause said switching circuit to switch from the supply state to the interrupted state if the detected current value drops below a reference value, and said control means outputs a control signal indicating said reference value.

14. A fixing device which used in an image forming apparatus for fixing a toner image on a sheet, said fixing device comprising:

a heat-receiving member comprised of a metal conductive member for generating heat and thermally fusing the toner image on the sheet;

a coil which is arranged near said heat-receiving member; and a driving circuit which produces a high frequency current and supplies the high frequency current to said coil so as to generate an induction current in said heat-receiving member and heat said heat-receiving member;

wherein said driving circuit includes;

a switching circuit which switches a current supply to said coil between a supply state and an interrupted state to generate the high frequency current to said coil, a voltage detection circuit which detects the voltage supplied to said coil and causes the switching circuit to switch from the interrupted state to the supply state when the detected voltage falls bellow a voltage reference level, a current detection circuit which detects the amount of the current flowing to said coil and causes the switching circuit to switch from the supply state to the interrupted state when the detected current exceeds a current reference level, and a level setting circuit which determines said current reference level in accordance with the amount of the current flowing to said coil.

15. A fixing device which used in an image forming apparatus for fixing a toner image on a sheet, said fixing device comprising:

a heat-receiving member comprised of a metal conductive member for generating heat and thermally fusing the toner image on the sheet;

a coil which is arranged near said heat-receiving member; and a driving circuit which produces a high frequency current from an electric power of a power source and supplies the high frequency current to said coil so as to generate an induction current in said heat-receiving member and heat said heat-receiving member;

where in said driving circuit includes;

a switching circuit which switches a current supply to said coil between a supply state and an interrupted state to generate the high frequency current to said coil, a voltage detection circuit which detects the voltage supplied to said coil, and a delay circuit which causes said switching circuit to switch from the interrupted state to the supply state after a delay time has elapsed when the detected voltage falls bellow a reference level.

16. The fixing device as claimed in claim 15 further comprising a control means for controlling the electric power of the high frequency current supplied to said coil, and said delay time is varied in accordance with the electric power controlled by said control means.

17. The fixing device as claimed in claim 16 further comprising a rectifier circuit which rectifies an alternating current of a commercial power to a direction current, wherein said driving circuit produces the high frequency current from said rectified current and includes a peak-hold circuit which detects the maximum voltage supplied to said coil at each one period of oscillation output by said rectifier circuit, and said delay time is varied in accordance with the maximum voltage detected by the peak-hold circuit.

18. The fixing device as claimed in claim 16 wherein said driving circuit includes a peak-hold circuit which detects the maximum voltage supplied to said coil at each switching cycle of said switching circuit, and said delay time is varied in accordance with the maximum voltage detected by the peak-hold circuit.

* * * * *

UNITED STATES PATENT AND TRADEMARK OFFICE

CERTIFICATE OF CORRECTION

PATENT NO. : 5,794,096

DATED : August 11, 1998

INVENTOR(S) : Eiji Okabayashi

It is certified that error appears in the above-identified patent and that said Letters Patent is hereby corrected as shown below:

Col. 26, line 36: Replace "bellow" with --below--

Signed and Sealed this

Twenty-ninth Day of December, 1998

*Attest:*

Bruce Lehman

BRUCE LEHMAN

*Attesting Officer*

*Commissioner of Patents and Trademarks*